US012486672B2

(12) United States Patent
Colyn et al.

(10) Patent No.: US 12,486,672 B2
(45) Date of Patent: Dec. 2, 2025

(54) SIDING PANEL WITH VARYING PROFILE AND SIDING SYSTEM

(71) Applicant: CertainTeed LLC, Malvern, PA (US)

(72) Inventors: Christopher Colyn, Philadelphia, PA (US); David J. Stucky, Grass Lake, MI (US)

(73) Assignee: CertainTeed LLC, Malvern, PA (US)

( * ) Notice: Subject to any disclaimer, the term of this patent is extended or adjusted under 35 U.S.C. 154(b) by 0 days.

(21) Appl. No.: 18/595,976

(22) Filed: Mar. 5, 2024

(65) Prior Publication Data

US 2024/0287816 A1 Aug. 29, 2024

Related U.S. Application Data

(63) Continuation of application No. 17/200,870, filed on Mar. 14, 2021, now Pat. No. 11,920,356.

(60) Provisional application No. 62/989,273, filed on Mar. 13, 2020.

(51) Int. Cl.
*E04F 13/08* (2006.01)
*E04F 13/18* (2006.01)

(52) U.S. Cl.
CPC ..... *E04F 13/0894* (2013.01); *E04F 13/18* (2013.01)

(58) Field of Classification Search
CPC ..... E04D 1/24; E04D 1/29; E04D 1/2907; E04D 2001/304; E04D 1/2928; E04D 1/2921; E04D 1/2956; E04D 1/2914; E04D 1/2916; E04D 1/2918; E04D 1/2935; E04D 1/2942; E04F 13/00
USPC .. 52/519, 523–526, 536, 537, 539, 557–559
See application file for complete search history.

(56) References Cited

U.S. PATENT DOCUMENTS 720,893 A * 2/1903 Charlebois ..... E04F 13/0894 52/529
5,022,207 A * 6/1991 Hartnett ..... E04F 13/08 52/525
5,074,093 A 12/1991 Meadows
(Continued)

OTHER PUBLICATIONS

Kavanaugh, Catherine, "Call going out to re-imagine vinyl siding," Plastics News, Jul. 28, 2016, 3 pages, available at http://www.plasticsnews.com/article/20160728/OPINION01/160729797.
(Continued)

*Primary Examiner* — Brian E Glessner
*Assistant Examiner* — Adam G Barlow
(74) *Attorney, Agent, or Firm* — McDonnell Boehnen Hulbert & Berghoff LLP

(57) ABSTRACT

The present disclosure relates generally to building surface panels, for example, polymer siding suitable for covering the exterior surface of a building. The present disclosure relates more particularly to a siding panel having a depth extending from a rear elevation to a front elevation. The siding panel includes a fastening strip at the upper side, an upper lock adjacent to the fastening strip, a lower lock at the lower side, and a panel body extending from the upper lock to the lower lock. The panel body has a contoured profile including an upper edge that is disposed at the front elevation and abuts the upper lock, a lower edge that is disposed at the front elevation and abuts the lower lock, and a first section disposed between the upper edge and the lower edge that projects toward the rear elevation of the siding panel to a first trough.

19 Claims, 16 Drawing Sheets

(56) References Cited

U.S. PATENT DOCUMENTS 5,622,020 A * 4/1997 Wood ..... E04F 13/0864 52/549
5,768,844 A * 6/1998 Grace, Sr. ..... E04D 3/32 52/549
5,979,135 A * 11/1999 Reeves ..... E04F 13/18 139/50
6,029,415 A * 2/2000 Culpepper ..... E04F 13/0864 52/522
6,062,789 A * 5/2000 Pope ..... E04F 13/18 411/480
6,065,260 A * 5/2000 Dickey ..... E04F 13/0864 52/529
6,321,500 B1 * 11/2001 Manning ..... E04F 13/0864 52/309.8
6,341,463 B1 * 1/2002 Dickey ..... E04F 13/0864 52/531
6,370,832 B1 * 4/2002 McGarry ..... E04F 13/0864 52/549
6,647,687 B2 * 11/2003 Kern ..... E04F 13/0864 52/522
8,069,629 B2 * 12/2011 Rockwell ..... D21H 21/18 52/794.1
8,136,323 B2 * 3/2012 King ..... E04F 13/0876 52/553
D752,776 S 3/2016 O'Neal
10,544,593 B2 * 1/2020 Schultz ..... E04F 13/0864
2004/0021141 A1 2/2004 Sung
2012/0247049 A1 * 10/2012 Wagner ..... E04F 13/0801 264/177.17
2018/0187421 A1 * 7/2018 Schultz ..... E04F 13/0864
2021/0102382 A1 * 4/2021 Shaw ..... E04F 13/0876
2021/0230878 A1 * 7/2021 Pina ..... E04F 13/18

OTHER PUBLICATIONS

Kavanaugh, Catherine, "Architects eye new blueprint for vinyl siding," Plastics News, Jul. 22, 2016, 3 pages, available at http://www.plasticsnews.com/article/20160722/NEWS/160729899.

* cited by examiner

SIDING PANEL WITH VARYING PROFILE AND SIDING SYSTEM

CROSS-REFERENCE TO RELATED APPLICATIONS

This application is a continuation of U.S. patent application Ser. No. 17/200,870, filed Mar. 14, 2021, which claims the benefit of priority of U.S. Provisional Patent Application No. 62/989,273, filed Mar. 13, 2021, each of which is hereby incorporated herein by reference in its entirety.

BACKGROUND OF THE DISCLOSURE

1. Field of the Disclosure

The present disclosure relates generally to building surface panels, for example, polymer siding suitable for covering the exterior surface of a building. The present disclosure relates more particularly to siding panels with a varying contoured profile.

2. Technical Background

Building surface panels, such as cladding or siding, are visible elements that cover an underlying support structure. The panels can provide protection of the support structure and also form the visible facade of the wall or other building surface. Siding panels are typically configured to be attached directly to the support structure, for example, using mechanical fasteners, adhesive, or another attachment method. In addition, siding panels often interconnect to one another, which strengthens the structural integrity of the surface and the overall connection of the panels to the support structure.

Siding panels come in various different shapes to allow for many different aesthetic options. For example, manufactured siding products can have many different profiles including clapboard, dutchlap, beaded, board and batten, shake siding, or shingle siding. Although there are a variety of different siding profile options, most of the foregoing profiles represent overlapping planks of wood. Accordingly, siding is very recognizable, and The present inventors have recognized that siding panels with additional alternative profiles would be attractive to builders and customers by allowing for a greater variety of surface designs.

SUMMARY OF THE DISCLOSURE

In one aspect, the present disclosure provides a siding panel having a length extending from a first end to a second end, a width extending from an upper side to a lower side, and a depth extending from a rear elevation to a front elevation, the siding panel comprising:

- a fastening strip at the upper side;
- an upper lock adjacent to the fastening strip;
- a lower lock at the lower side; and
- a panel body extending from the upper lock to the lower lock, the panel body having a contoured profile including:
  - an upper edge that is disposed at the front elevation and abuts the upper lock,
  - a lower edge that is disposed at the front elevation and abuts the lower lock, and

- a first section disposed between the upper edge and the lower edge that projects toward the rear elevation of the siding panel to a first trough.

In another aspect, the disclosure provides a siding kit for covering a building surface, the siding kit comprising:

- a first siding panel according to the disclosure, the first siding panel having a panel body with a first contoured profile; and
- a second siding panel according to the disclosure configured to attach to the first siding panel, the second siding panel having a panel body with a second contoured profile that is different from the first contoured profile.

In another aspect, the disclosure provides a building surface siding system comprising:

- a support structure;
- a first siding panel according to the disclosure attached to the support structure, the first siding panel having a panel body with a first contoured profile; and
- a second siding panel according to the disclosure attached to the support structure and coupled to the first siding panel, the second siding panel having a panel body with a second contoured profile that is different from the first contoured profile.

Additional aspects of the disclosure will be evident from the disclosure herein.

BRIEF DESCRIPTION OF THE DRAWINGS

The accompanying drawings are included to provide a further understanding of the methods and devices of the disclosure, and are incorporated in and constitute a part of this specification. The drawings are not necessarily to scale, and sizes of various elements may be distorted for clarity. The drawings illustrate one or more embodiment(s) of the disclosure, and together with the description serve to explain the principles and operation of the disclosure.

DETAILED DESCRIPTION

As described above, the present inventors have noted that conventional siding systems have several recognizable profile shapes with various consistencies. The present inventors have determined that siding panels including alternative contoured profiles would be attractive to builders and customers.

Accordingly, one aspect of the disclosure is a siding panel having a length extending from a first end to a second end, a width extending from an upper side to a lower side, and a depth extending from a rear elevation to a front elevation. The siding panel includes a fastening strip at the upper side, an upper lock adjacent to the fastening strip, a lower lock at the lower side, and a panel body extending from the upper lock to the lower lock. The panel body has a contoured profile including an upper edge that is disposed at the front elevation and abuts the upper lock, a lower edge that is disposed at the front elevation and abuts the lower lock, and a first section disposed between the upper edge and the lower edge that projects toward the rear elevation of the siding panel to a first trough.

Figure 1A:
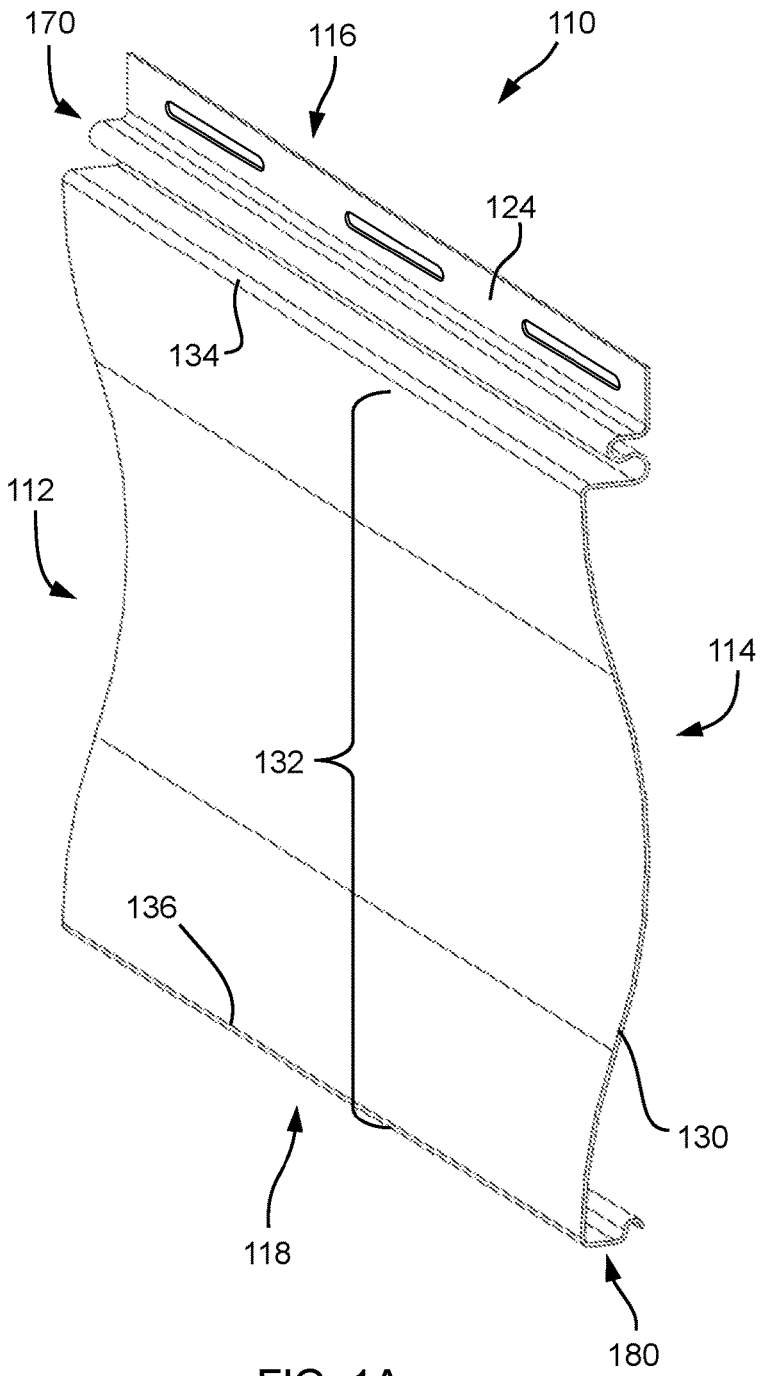
FIG. 1A is a schematic perspective view of a siding panel according to an embodiment of the disclosure.
Figure 1B:
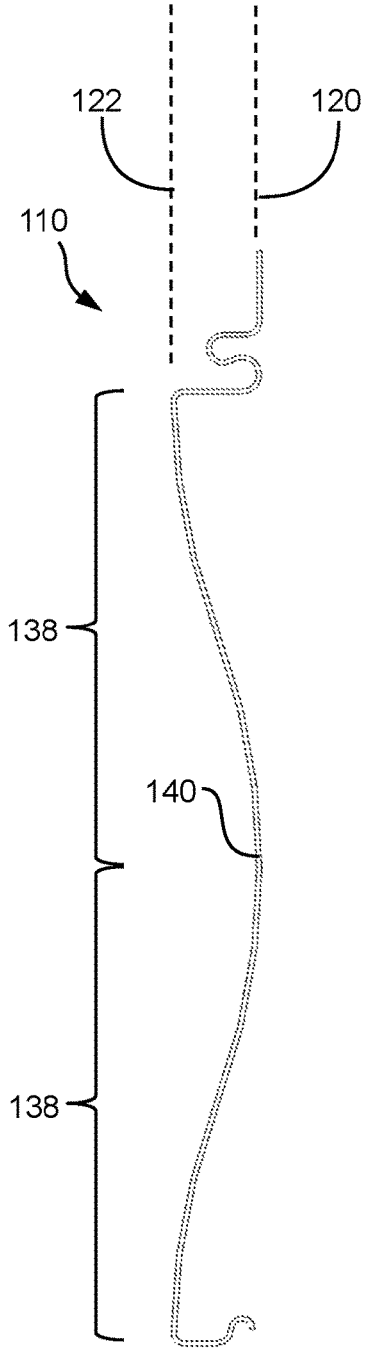
FIG. 1B is schematic a side view of the siding panel of FIG. 1A.

Such a siding panel is shown in perspective view in FIG. 1A and cross-sectional side view in FIG. 1B. Siding panel 110 has a length that extends from a first end 112 to a second end 114 and a width that extends from an upper side 116 to a lower side 118. Siding panel 110 also has a depth that extends between a rear elevation 120 to a front elevation 122, as illustrated in FIG. 1B. Siding panel 110 includes a fastening strip 124 that is configured to secure siding panel 110 to a support structure, as described in more detail below. Siding panel 110 also includes an upper lock 170 adjacent to fastening strip 124 and a lower lock 180. Further, a panel body 130 extends from upper lock 170 to lower lock 180.

Panel body 130 forms the majority of the visible portion of siding panel 110 when it is attached to a support structure and has a contoured profile 132 that characterizes the aesthetic of the siding panel. Contoured profile 132 of panel body 130 includes an upper edge 134 that abuts upper lock 170 and a lower edge 136 that abuts lower lock 180. Both upper edge 134 and lower edge 136 are disposed at the front elevation 122 of siding panel 110. Between upper edge 134 and lower edge 136, contoured profile 132 has a rolling curved shape including a first section 138 that extends toward the rear elevation 120 of siding panel 110. First section 138 extends from upper edge 134 to a first trough 140 that is between upper edge 134 and lower edge 136.

Figure 2A:
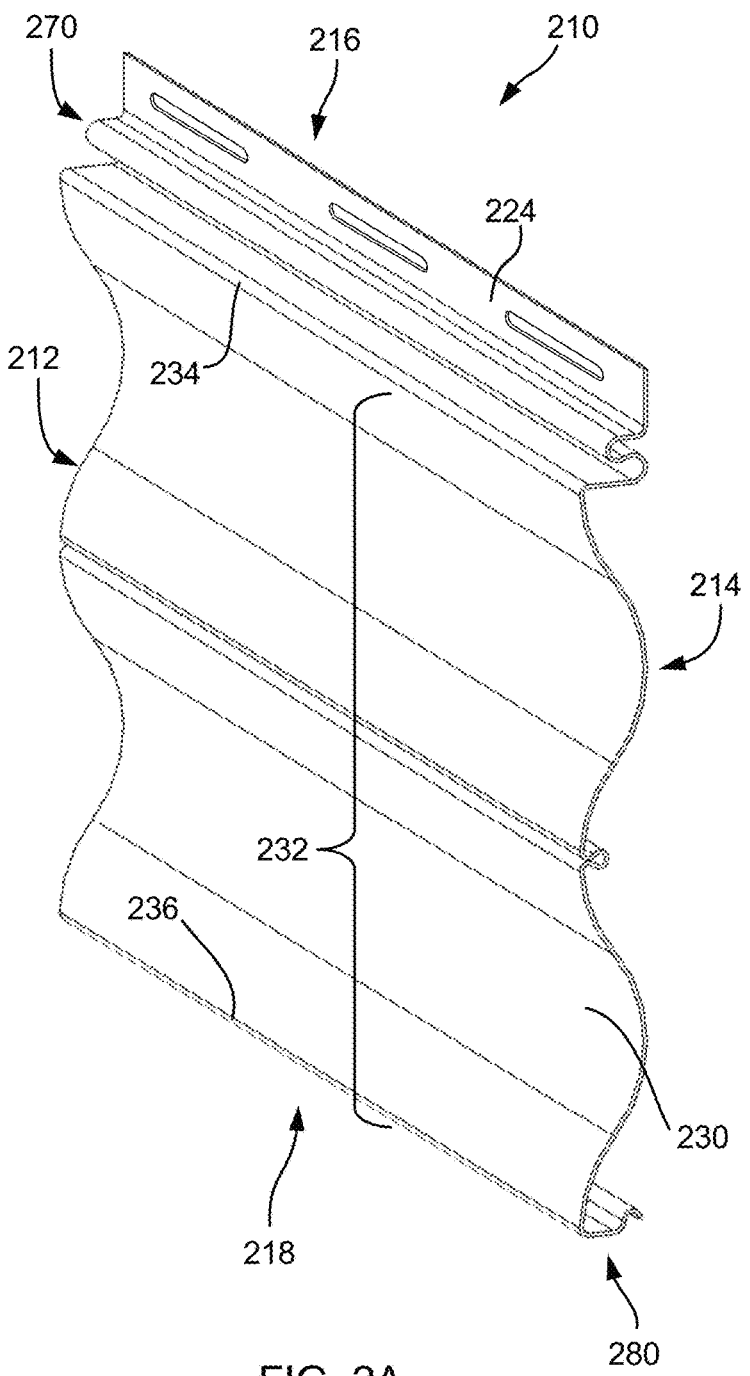
FIG. 2A is a schematic perspective view of a siding panel according to another embodiment of the disclosure.
Figure 2B:
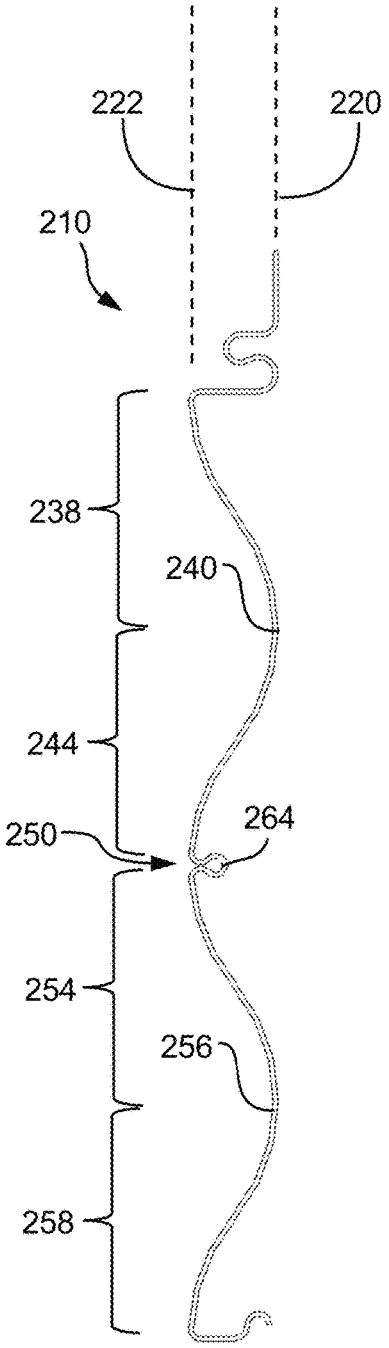
FIG. 2B is schematic a side view of the siding panel of FIG. 2A.

FIGS. 2A and 2B show another embodiment of a siding panel according to an embodiment of the disclosure. The length of siding panel 210 extends from a first end 212 to a second end 214 and the width extends from an upper side 216 to a lower side 218. Further, the depth of siding panel 210 extends from a rear elevation 220 to a front elevation 222, as illustrated in FIG. 2B. The siding panel 210 also includes a fastening strip 224 for securing the siding panel to a support structure, an upper lock 270 adjacent to fastening strip 224, a panel body 230, and a lower lock 280.

Panel body 230 has a contoured profile 232 that includes an upper edge 234 abutting upper lock 270 and a lower edge 236 abutting lower lock 280. Both upper edge 234 and lower edge 236 are disposed at the front elevation 222 of siding panel 210. Between upper edge 234 and lower edge 236, contoured profile 232 has a rolling curved shape including a first section 238 that extends toward the rear elevation 220 of siding panel 210. First section 238 extends from upper edge 234 to a first trough 240 that is between upper edge 234 and lower edge 236.

Figure 3:
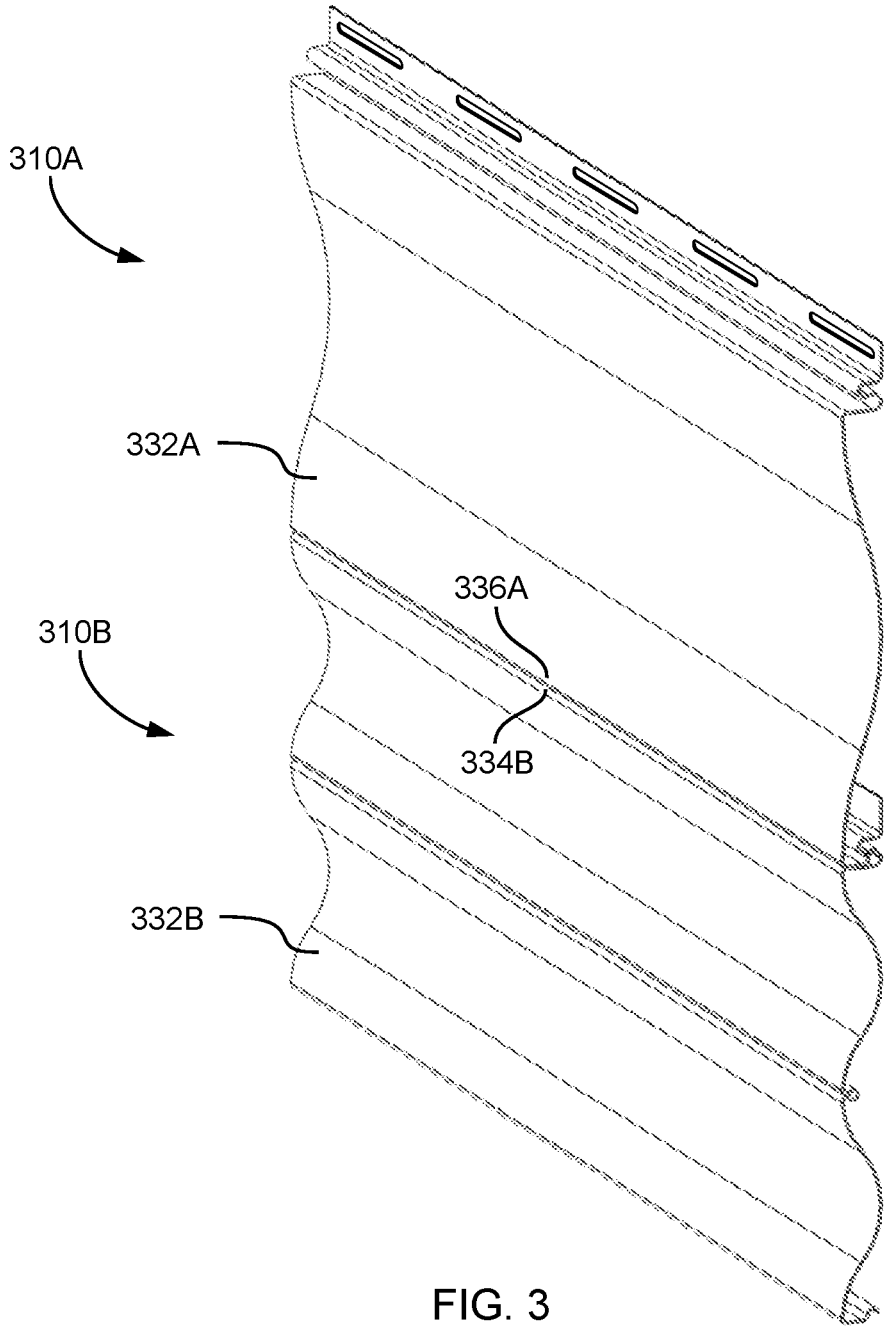
FIG. 3 is a schematic perspective view of two siding panels according to an embodiment of the disclosure adjacent to one another.

FIG. 3 shows two siding panels attached to one another. First siding panel 310A has a contoured profile 332A that is similar to contoured profile 132 of siding panel 110, described above, with a single rolling wave. Likewise, second siding panel 310B has a contoured profile 332B that is similar to contoured profile 232 of siding panel 210, with a double rolling wave. The geometry of the contoured profiles 332A and 332B provides a smooth continuous surface between the first siding panel 310A and second siding panel 310B, despite the two panels having different contoured profiles. In particular, both siding panels 310A and 310B have the same depth and the upper and lower edges of the contoured profiles are at the front elevation of the panels. Accordingly, there is a smooth transition from the first siding panel 310A to the second siding panel 310B without any step in the depth direction. Specifically, because the lower edge 336A of first siding panel 310A is positioned at the front elevation and the upper edge 334B of the second siding panel 310B is also positioned at the front elevation, the two edges 336A and 334B are adjacent to one another and provide a visual of a continuing surface.

In certain embodiments of the siding panel as otherwise described herein, the first section has a curved slope. For example, first section 138 of contoured profile 132 of siding panel 110 has a curved slope, as shown in FIGS. 1A and 1B. In particular, a portion of first section 138 adjacent to upper edge 134 has a convex curvature, which transitions to a concave curvature near first trough 140. The resulting profile has a varying curved shape similar to a sinusoidal wave. This shape allows for a smooth transition at the rear and front elevations of the siding panel.

Similarly, siding panel 210, shown in FIG. 2, also has a first section 238 with a curved slope. However, first section 238 of contoured profile 232 is shorter than that of siding panel 210, because contoured profile 232 has the same width as contoured profile 132 but includes two waves rather than one.

Figure 4A:
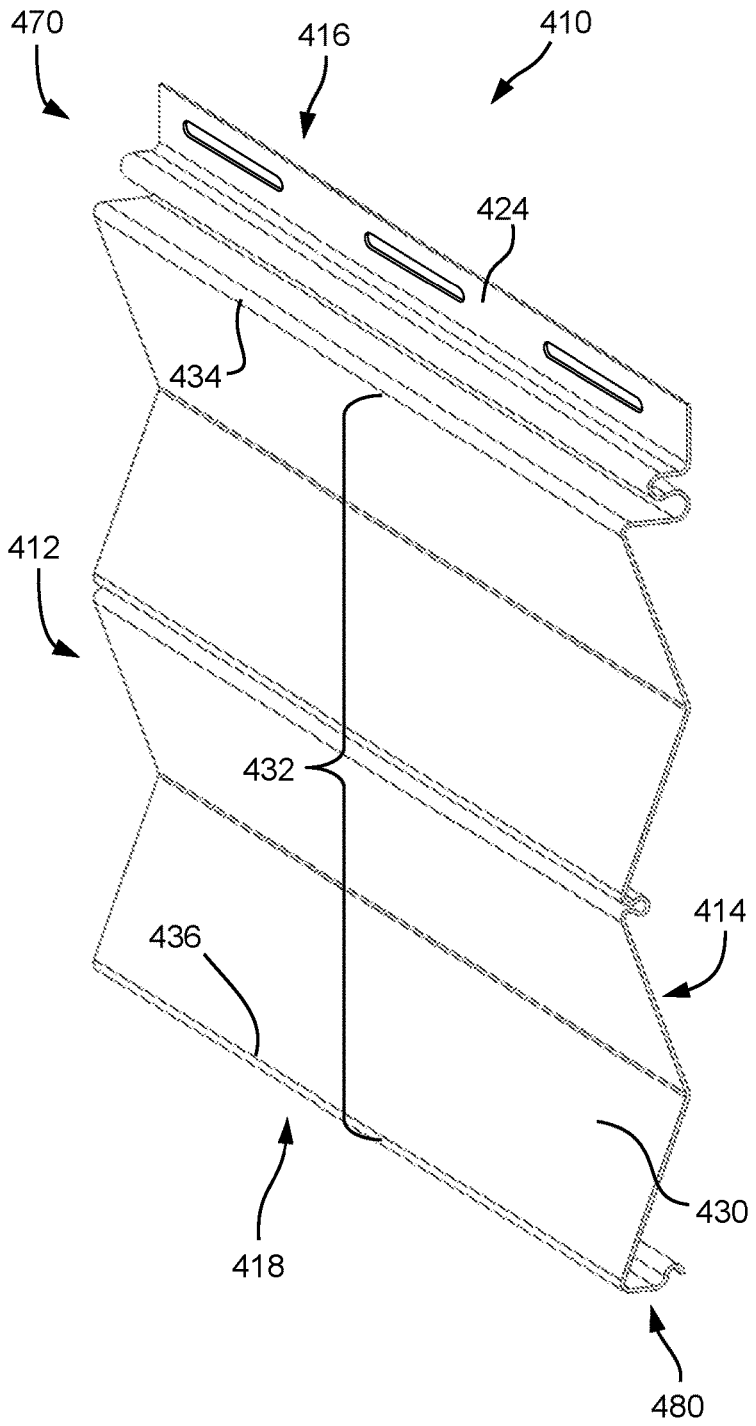
FIG. 4A is a schematic perspective view of a siding panel according to another embodiment of the disclosure.
Figure 4B:
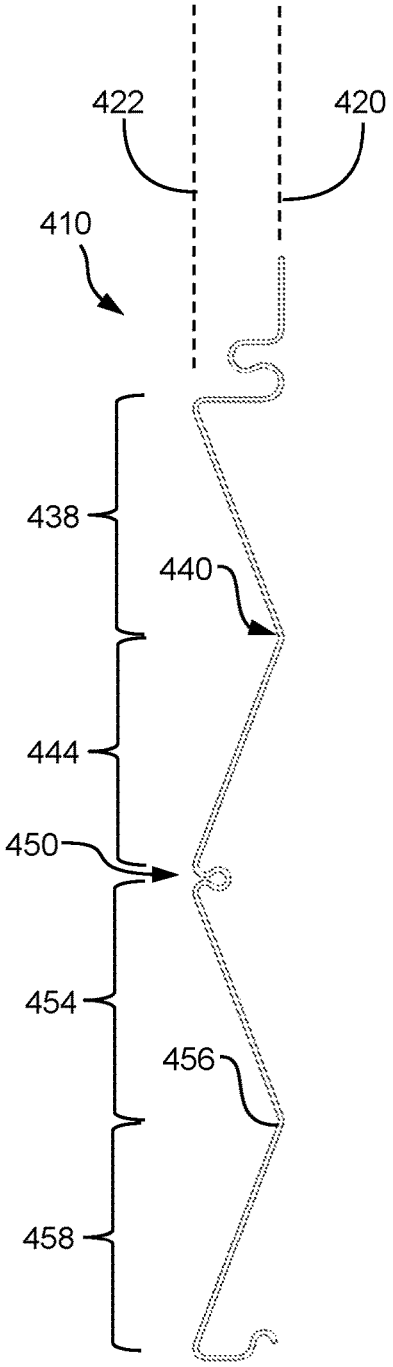
FIG. 4B is a schematic side view of the siding panel of FIG. 4A.

In certain embodiments of the siding panel as otherwise described herein, the first section has a flat angled slope. For example, a siding panel including a contoured profile with a first section having a flat angled slope is shown in FIGS. 4A and 4B. Siding panel 410 includes a first end 412, a second end 414, an upper side 416, and a lower side 418. The depth of siding panel 410 extends between a rear elevation 420 and a front elevation 422. Further, siding panel 410 includes a fastening strip 424, an upper lock 470, a lower lock 480, and a panel body 430, which has a contoured profile 432 extending from an upper edge 434 to a lower edge 436. The contoured profile 432 of siding panel 410 includes a flat first section 438 extending between upper edge 434 and first trough 440. Moreover, contoured profile 432 also includes an angled corner 442 between upper lock 470 and first section 438, such that first section 438 extends at an angle toward the first trough 440. Similarly, first trough 440 is also in the form of a cornered trench that advances to a flat second section 444 that extends back toward the front elevation 422.

Figure 5A:
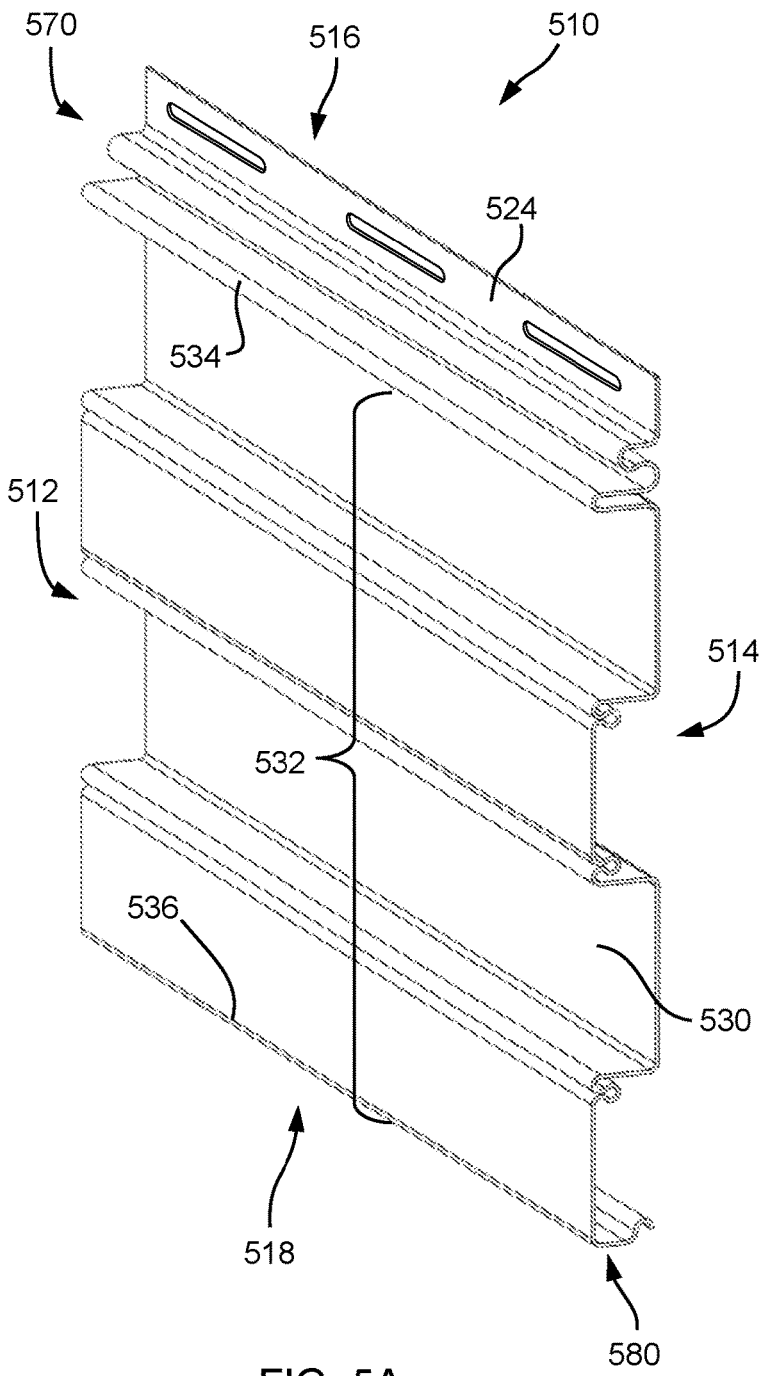
FIG. 5A is a schematic perspective view of a siding panel according to yet another embodiment of the disclosure.
Figure 5B:
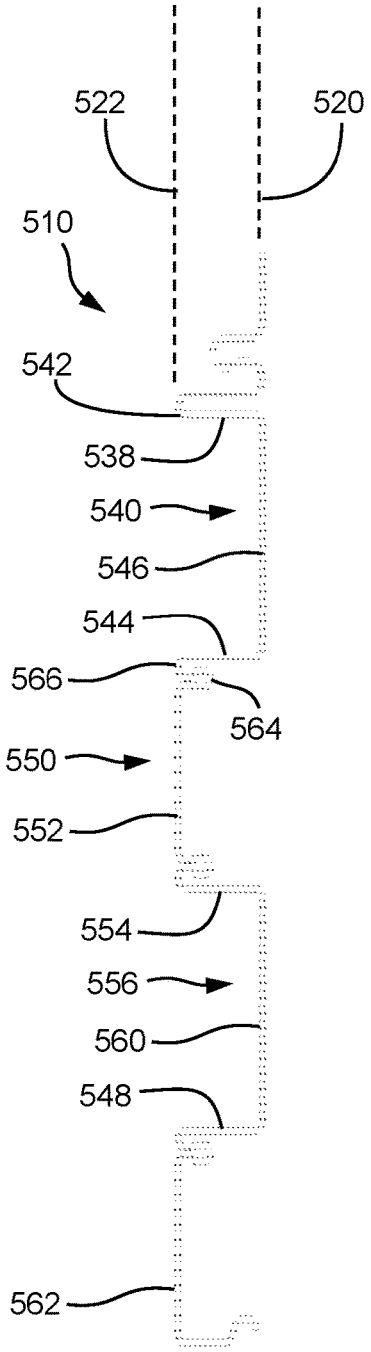
FIG. 5B is a schematic side view of the siding panel of FIG. 5A.

In certain embodiments of the siding panel as otherwise described herein, the first section projects substantially parallel to the depth direction of the siding panel. For example, a siding panel including a contoured profile with a first section that projects substantially parallel to the depth direction of the siding panel is shown in FIGS. 5A and 5B. Siding panel 510 includes a first end 512, a second end 514, an upper side 516, and a lower side 518. The depth of siding panel 510 extends between a rear elevation 520 and a front elevation 522. Further, siding panel 510 includes a fastening strip 524, an upper lock 570, a lower lock 580, and a panel body 530, which has a contoured profile 532 extending from an upper edge 534 to a lower edge 536. The contoured profile 532 of siding panel 510 includes a square corner 542 at upper lock 570 that transitions to first section 538. As a result, first section 538 extends rearward from the front of siding panel 510 in a direction that is substantially parallel to the depth direction. The term substantially parallel, as used herein, refers to directions that are within 5 degrees of parallel.

In certain embodiments of the siding panel as otherwise described herein, the first trough includes a planar rear section that is perpendicular to the depth direction. For example, contoured profile 532 includes a planar rear section 546 that forms first trough 540. Planar rear section 546 is connected to first section 538 by a rear corner 548 and runs parallel to the width and length directions of siding panel 510. Moreover, planar rear section 546 extends to a second section 544 that projects toward front elevation 522 and is parallel to the depth direction. The resulting contoured profile 532 is in the form of a square wave.

While the sections 538, 544 that run parallel to the depth direction in contoured profile 532 are positioned on either side of planar rear section 546, thereby forming sections that are at right angles to one another, in other embodiments, such sections are adjacent to angled or curved sections. For example, in some embodiments, a first section that runs parallel to the depth direction is adjacent to an angled or curved second section. In other embodiments, a planar rear section is adjacent to an angled or curved first section or second section.

In certain embodiments of the siding panel as otherwise described herein, the contoured profile includes a second section that projects from the first trough to the lower edge. For example, the contoured profile 132 of panel body 130 of siding panel 110 includes a second section 144 that extends from first trough 140 to lower edge 136. Thus, first section 138 and second section 144 extend across most of the width of contoured profile 132.

On the other hand, in certain embodiments of the siding panel as otherwise described herein, the contoured profile includes a second section that projects from the first trough to a peak disposed between the upper edge and the lower edge. For example, the contoured profile 232 of panel body 230 of siding panel 210, as shown in FIG. 2B, includes a second section 244 that extends from first trough 240 to a peak 250 disposed toward the middle of contoured profile 232. Similarly, the contoured profile 432 of panel body 430 of siding panel 410, as shown in FIG. 4B, includes a second section 444 that extends from first trough 440 to a peak 450 disposed toward the middle of contoured profile 432.

In certain embodiments of the siding panel as otherwise described herein, the peak includes a planar front section that is perpendicular to the depth direction. For example, the contoured profile 532 of panel body 530 of siding panel 510 includes a second section 544 that extends from first trough 540 to a peak 550 that is in the form of a planar front section 552. The planar front section 552 of contoured profile 532 continues the square wave design of the panel body, as described above.

In certain embodiments of the siding panel as otherwise described herein, the siding panel further includes a third section that extends from the peak to a second trough, and a fourth section that extends from the second trough to the lower edge. For example, the contoured profile 232 of panel body 230 of siding panel 210, as shown in FIG. 2B includes a third section 254 that extends from peak 250 to a second trough 256 and a fourth section 258 that extends from second trough 256 to lower edge 236. Similarly, the contoured profile 432 of panel body 430 of siding panel 410, as shown in FIG. 4B, includes a third section 454 that extends from peak 450 to a second trough 456 and a fourth section 458 that extends from second trough 456 to lower edge 436. Moreover, the contoured profile 532 of panel body 530 of siding panel 510, as shown in FIG. 5B, also includes a third section 554 that extends from peak 550 to a second trough 556 in the form of a second planar rear section 560. A fourth section 558 extends from the second planar rear section to a second planar front section 562, thereby maintaining the square wave design of siding panel 510.

In certain embodiments of the siding panel as otherwise described herein, the first trough is disposed at the rear elevation. For example, first trough 140 of contoured profile 132 is disposed at the rear elevation 120 of siding panel 110. Accordingly, first section 138 of contoured profile 132 extends over substantially the entire depth of siding panel 110 from the front elevation 122 to the rear elevation 120. Likewise, the first trough 240 of contoured profile 232, the rear trough 440 of contoured profile 432, and the first trough 540 of contoured profile 532 are all disposed at the rear elevation 220, 420, 520 of the respective siding panel 210, 410, 510. In other embodiments, the first trough is disposed at a depth that is intermediate of the front elevation and the rear elevation. Further, while in siding panels 210, 410 and 510, the first trough and the second trough are at the same depth, in other embodiments with more than one trough, the troughs are at different depths.

In certain embodiments of the siding panel as otherwise described herein, the contoured profile includes a groove extending along the length of the siding panel. For example, siding panel 210 includes a groove 264 in the middle of contoured profile 232 that runs along the length of the siding panel. The groove 264 forms a break between the adjacent second section 244 and third section 254. Siding panels 410 and 510 include similar grooves. In some embodiments, the groove is formed by bending a fold into the material that forms the siding panel. In other embodiments, the groove is cut or machined into the siding panel. Other methods of forming a groove are also possible.

In certain embodiments of the siding panel as otherwise described herein, the groove is disposed at a peak in the contoured profile. For example, groove 264 that is formed as part of contoured profile 232 of panel body 230 is disposed at peak 250 in the middle of the contoured profile. In other embodiments, one or more grooves are positioned at other locations across the width of the siding panel. For example, contoured profile 532 of siding panel 510 includes several grooves including groove 564 located adjacent to planar font section 552.

In certain embodiments of the siding panel as otherwise described herein, the contoured profile includes a bead extending along the length of the siding panel. For example, contoured profile 532 of siding panel 510 has several beads including bead 566, which is positioned between second section 544 and groove 564. The bead 566 is formed as a folded section of the panel body 530 and forms a ridge that extends across the siding panel, as will be appreciated by those of ordinary skill in the art.

Figure 6A:
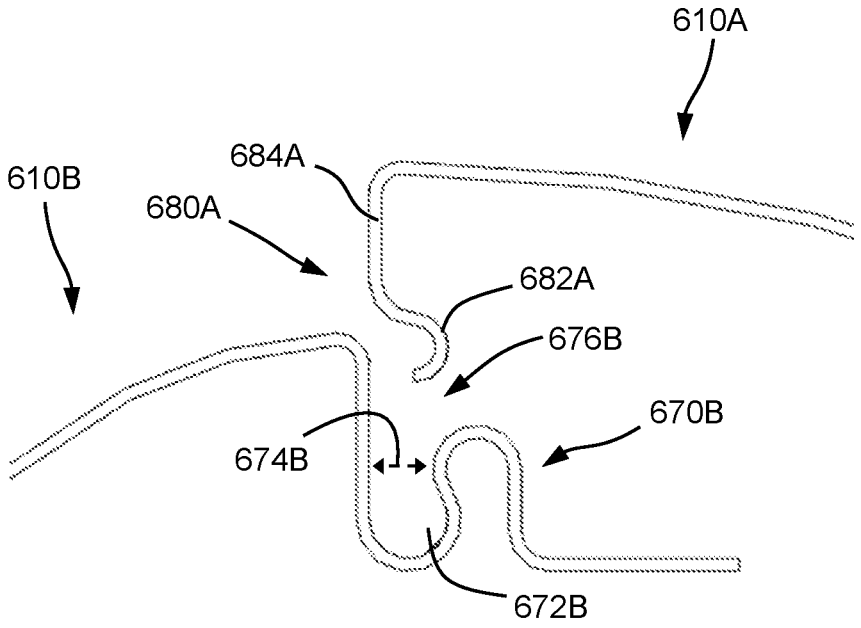
FIG. 6A is a schematic side view of the locks of two siding panels according to an embodiment of the disclosure in a first position.
Figure 6B:
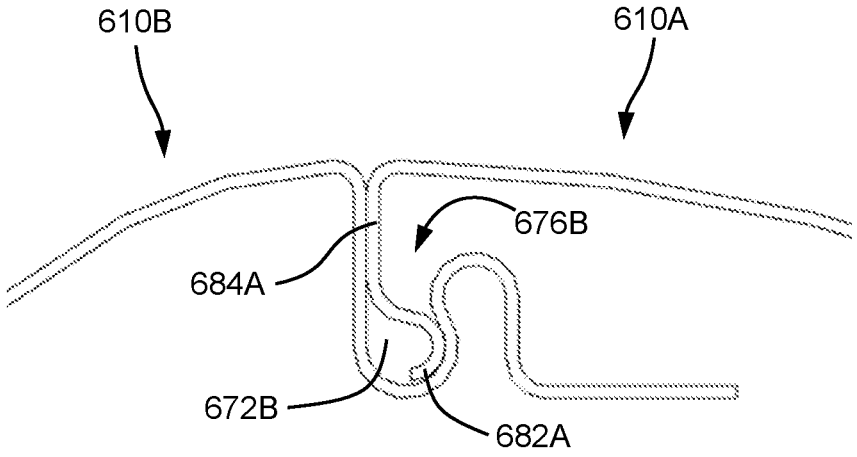
FIG. 6B is a schematic side view of the locks of FIG. 6B in a second position.

In certain embodiments of the siding panel as otherwise described herein, the upper lock includes a cavity configured to receive an insert of the lower lock. Such a lock configuration is shown in FIGS. 6A and 6B. FIG. 6A shows an enlarged schematic side view of a portion of a first siding panel 610A and a second siding panel 610B positioned to engage with one another. In particular, first siding panel 610A includes a lower lock 680A with an insert 682A that is positioned to be introduced into a corresponding recess 672B of the upper lock 670B of second siding panel 610B. As shown in FIG. 6B, the lower lock 680A of first siding panel 610A is moved toward upper lock 670B of second siding panel 610B so as to place insert 682A inside recess 672B.

In certain embodiments of the siding panel as otherwise described herein, the recess includes a constricted opening. For example, recess 672B of upper lock 670B has a constricted opening 674B, which aids in retaining insert 682A within recess 672B. In some embodiments, the insert is bulbous. For example, insert 682A has a bulbous end. Accordingly, when insert 682A is inserted into recess 672B, the bulbous shape of the insert 682A and the constricted opening 674B or recess 672B hinder removal of the insert and disengagement of the upper lock 670B and lower lock 680A.

In certain embodiments of the siding panel as otherwise described herein, the insert is bulbous. For example, the end of lower lock 680A is formed by a curve in the siding panel material so as to form insert 682A in a bulbous shape. The bulbous shape of insert 682A cooperates with the constricted opening 674B of recess 672B so as to retain insert 682A within recess 672B. In particular, in order to introduce insert 682A into recess 672B, at least one of insert 682A and recess 672B deform as insert 682A passes through the restricted opening 674B. As a result, a similar deformation is needed to remove insert 682A from recess 672B, such that insert upper lock 670B and lower lock 680A are securely engaged.

In certain embodiments of the siding panel as otherwise described herein, the insert is in the form of a hook. For example, in some embodiments, the insert of the lower lock is in the shape of a hook and is configured to fasten over an edge and into the recess of the upper lock.

In certain embodiments of the siding panel as otherwise described herein, the recess is disposed at the base of a cavity and the insert is disposed at the end of a leg. For example, recess 672B of upper lock 670B is disposed at the base of a cavity 676B. In order for insert 682A to reach recess 672B at the base of cavity 676B, insert 682A is likewise positioned at the end of a leg 684A. The positioning of the insert at the end of a leg and the recess at the base of a cavity places the respective lower and upper edges of the panel body further from the rear elevation of the siding panel, which increases the depth of the siding panel. Accordingly, the contoured profile of the panel body can curve and bend over a range of depths.

In certain embodiments of the siding panel as otherwise described herein, a cross section of the contoured profile is substantially uniform along the length of the siding panel. For example, in some embodiments, the siding panel is formed from a long sheet of material that is bent and folded to form various curves in the siding panel, including the panel body. Moreover, in some embodiments, each bend and curve extends along the entire length of the siding panel, such that the cross section of the panel body is the same along its entire length.

In certain embodiments of the siding panel as otherwise described herein, the depth of the siding panel is at least 2 inches, e.g., at least 2.5 inches, e.g., at least 3 inches. Further, in some embodiments the depth of the siding panel is no more than 8 inches, e.g., no more than 6 inches, e.g., no more than 4.5 inches. For example, in some embodiments, the depth of the siding panel is in a range from 2 inches to 8 inches, e.g., from 2.5 inches to 6 inches, e.g., from 3 inches to 4.5 inches. Such a depth allows for a varying contoured profile in the depth direction of the siding panel.

In certain embodiments of the siding panel as otherwise described herein, the length of the siding panel is at least 3 feet, e.g., at least 6 feet, e.g., at least 8 feet. Further, in some embodiments, the length of the siding panel is no more than 30 feet, e.g., no more than 20 feet, e.g., no more than 15 feet. For example, in some embodiments, the length of the siding panel is in a range from 3 feet to 30 feet, e.g., from 6 feet to 20 feet, e.g., from 8 feet to 15 feet. Likewise, in some embodiments, the width of the panel body is at least 4 inches, e.g., at least 6 inches, e.g., at least 8 inches. Further, in some embodiments, the width of the panel body is no more than 24 inches, e.g., no more than 18 inches, e.g., no more than 14 inches. For example, in some embodiments, the width of the panel body is in a range from 4 inches to 24 inches, e.g., from 6 inches to 18 inches, e.g., from 8 inches to 14 inches.

In certain embodiments of the siding panel as otherwise described herein, the panel body has a material thickness in a range from 0.03 inches to 0.20 inches. For example, in some embodiments, the panel body is formed as a thin wall that is molded or extruded. Accordingly, in some embodiments, the panel body, the locks, and the fastening strip can be extruded or molded together in a single operation.

Embodiments of the siding panel may be formed from various different materials, and may be constructed in a single piece or in layers of material. For example, in certain embodiments of the siding panel as otherwise described herein, the panel body is formed of one or more of polypropylene, polyethylene, polyvinyl chloride (PVC), acrylonitrile styrene acrylate (ASA), acrylonitrile ethylene styrene (AES), polyurethane, or acrylonitrile butadiene styrene (ABS). In other embodiments, the siding panel is formed of a non-polymer material. For example, in some embodiments the siding panel is formed of a metal, such as aluminum, steel, or tin.

In certain embodiments of the siding panel as otherwise described herein, the fastening strip includes apertures configured to receive mechanical fasteners. For example, fastening strip 124 of siding panel 110 includes apertures 126 in the form of elongate slots that are configured to receive mechanical fasteners for affixing siding panel 110 to a support structure. The use of an aperture in the form of a slot allows the siding panel to move longitudinally with respect to the mechanical fastener, which is useful for accommodating expansion and contraction of the siding panel with fluctuations in temperature.

In another aspect, the disclosure provides a siding kit for covering a building surface. The siding kit includes a first siding panel according to the disclosure that has a first contoured profile and a second siding panel according to the disclosure that has a second contoured profile that is different from the first contoured profile. Further, the second siding panel is configured to attach to the first siding panel.

Figure 7:
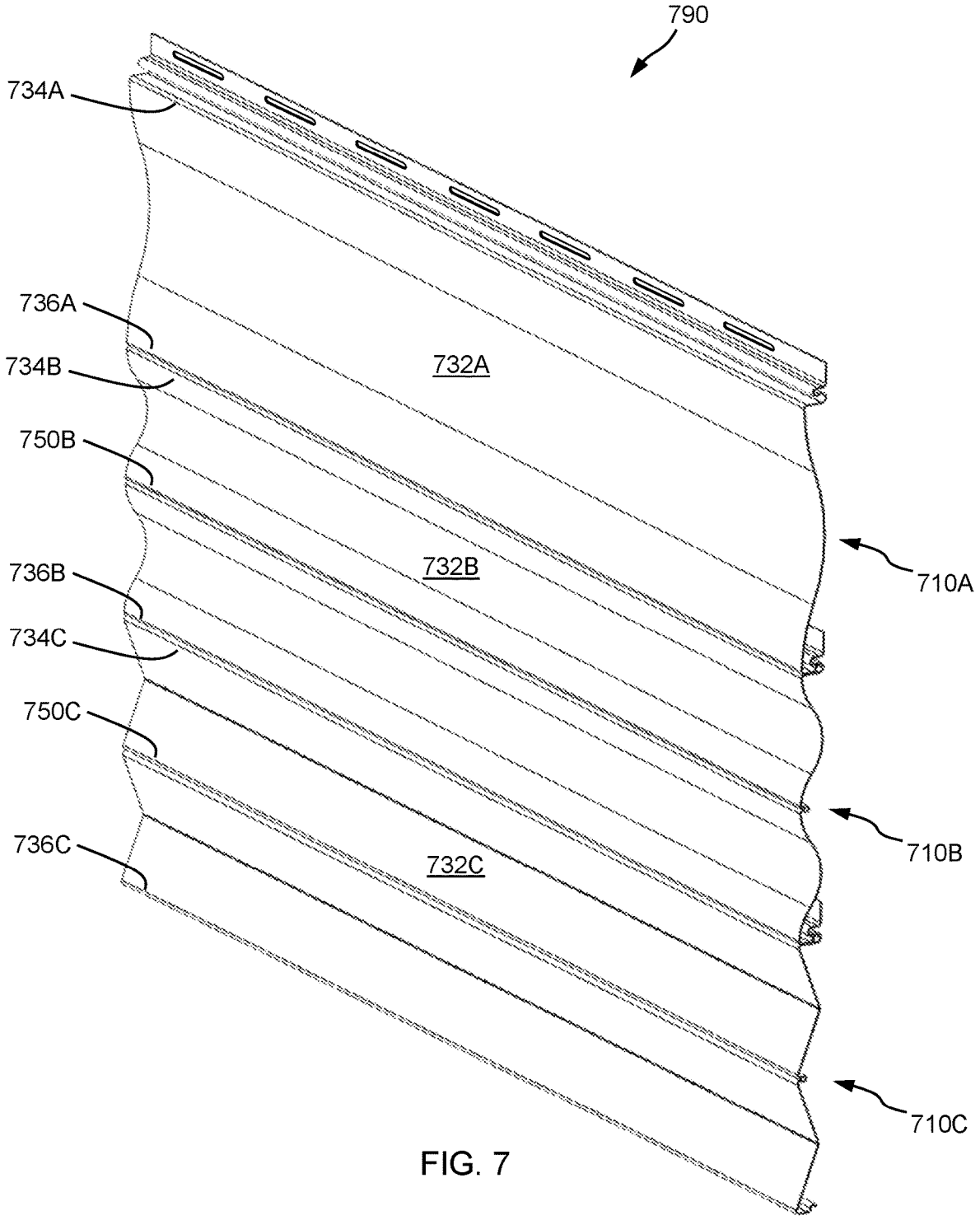
FIG. 7 is a schematic perspective view of a siding kit according to an embodiment of the disclosure.

Such a siding kit is shown in FIG. 7. Siding kit 790 includes a first siding panel 710A that has a panel body with a first contoured profile 732A. In particular, the first contoured profile 732A of first siding panel 710A is in the form of a single rolling wave that extends from the upper edge 734A through a trough to the lower edge 736A. Siding kit 790 also includes a second siding panel 710B that has a panel body with a second contoured profile 732B. The second contoured profile 732B is in the form of a double rolling wave with an upper wave that extends from the upper edge 734B through a trough to a peak 750B and a lower wave that extends from the peak 750B through a trough to the lower edge 736B. The first siding panel 710A is attached to the second panel 710B by connecting the lower lock of first siding panel 710A with the upper lock of second siding panel 710B.

In certain embodiments of the siding kit as otherwise described herein, the depth of the first siding panel is the same as the depth of the second siding panel. For example, the depth of first siding panel 710A of siding kit 790 is the same as the depth of second siding panel 710B. As a result, the surfaces at the front of first siding panel 710A will project outward from an underlying support structure the same distance as the surfaces at the front of second siding panel 710B. In particular, upper edge 734A and lower edge 736A of contoured profile 732A of first siding panel 710A will project outward from an underlying support structure the same distance as upper edge 734B and lower edge 736B of contoured profile 732B of second siding panel 710B.

In certain embodiments of the siding kit as otherwise described herein, the siding kit further includes a third siding panel according to the disclosure. For example, siding kit 790 includes a third siding panel 710C. In some embodiments, the third siding panel has a panel body with a third contoured profile that is different from the first siding profile and the second contoured profile. For example, third siding panel 710C of siding kit 790 has a panel body with a third contoured profile 732C. The third contoured profile 732B is different from the first contoured profile 732A and the second contoured profile 732B. In particular, third contoured profile 732C is in the form of an angled pattern with an upper portion that extends from the upper edge 734C through a trough to a peak 750C and a lower portion that extends from the peak 750C through a trough to the lower edge 736C.

Figure 8:
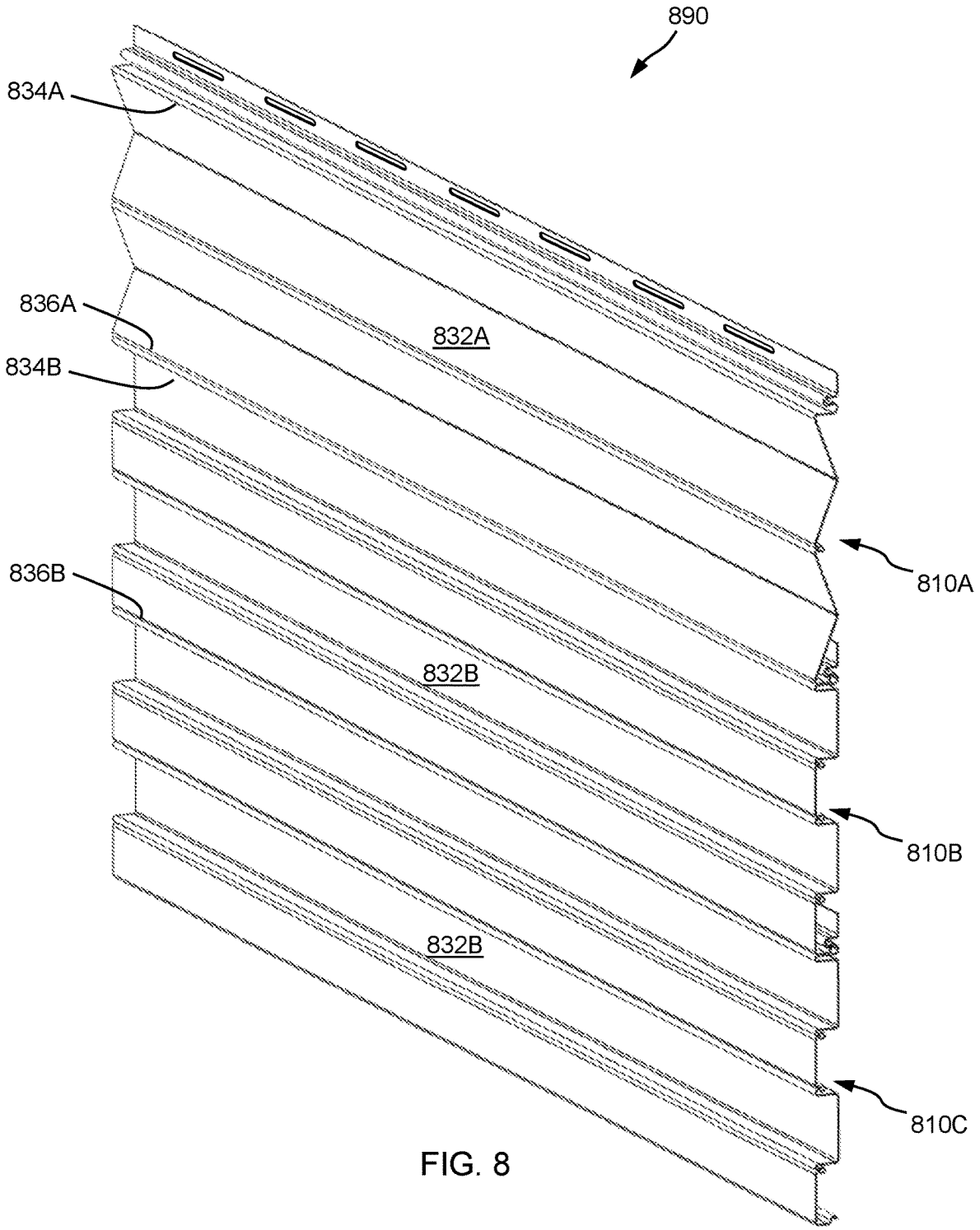
FIG. 8 is a schematic perspective view of a siding kit according to another embodiment of the disclosure.

In certain embodiments of the siding kit as otherwise described herein, the third siding panel has a panel body with the second contoured profile. Such a siding kit is shown in FIG. 8. Siding kit 890 includes a first siding panel 810A that has a panel body with a first contoured profile 832A. In particular, the first contoured profile 832A of first siding panel 810A is in the form of an angled pattern that extends from an upper edge 834A to a lower edge 836A. Siding kit 890 also includes a second siding panel 810B that has a panel body with a second contoured profile 832B. The second contoured profile 832B is in the form of a square pattern that extends from the upper edge 834B to a lower edge 836B. Siding kit 890 also includes a third siding panel 810C that has the second contoured profile 832B. In other words, the contoured profile of third siding panel 810C is the same as that of second siding panel 810B.

In another aspect the disclosure provides a building surface siding system. The building surface siding system includes a support structure, a first siding panel according to the disclosure attached to the support structure, and a second siding panel attached to the support structure and coupled to the first siding panel. The first siding panel has a panel body with a first contoured profile and the second siding panel has a panel body with a second contoured profile that is different from the first contoured profile.

Figure 9:
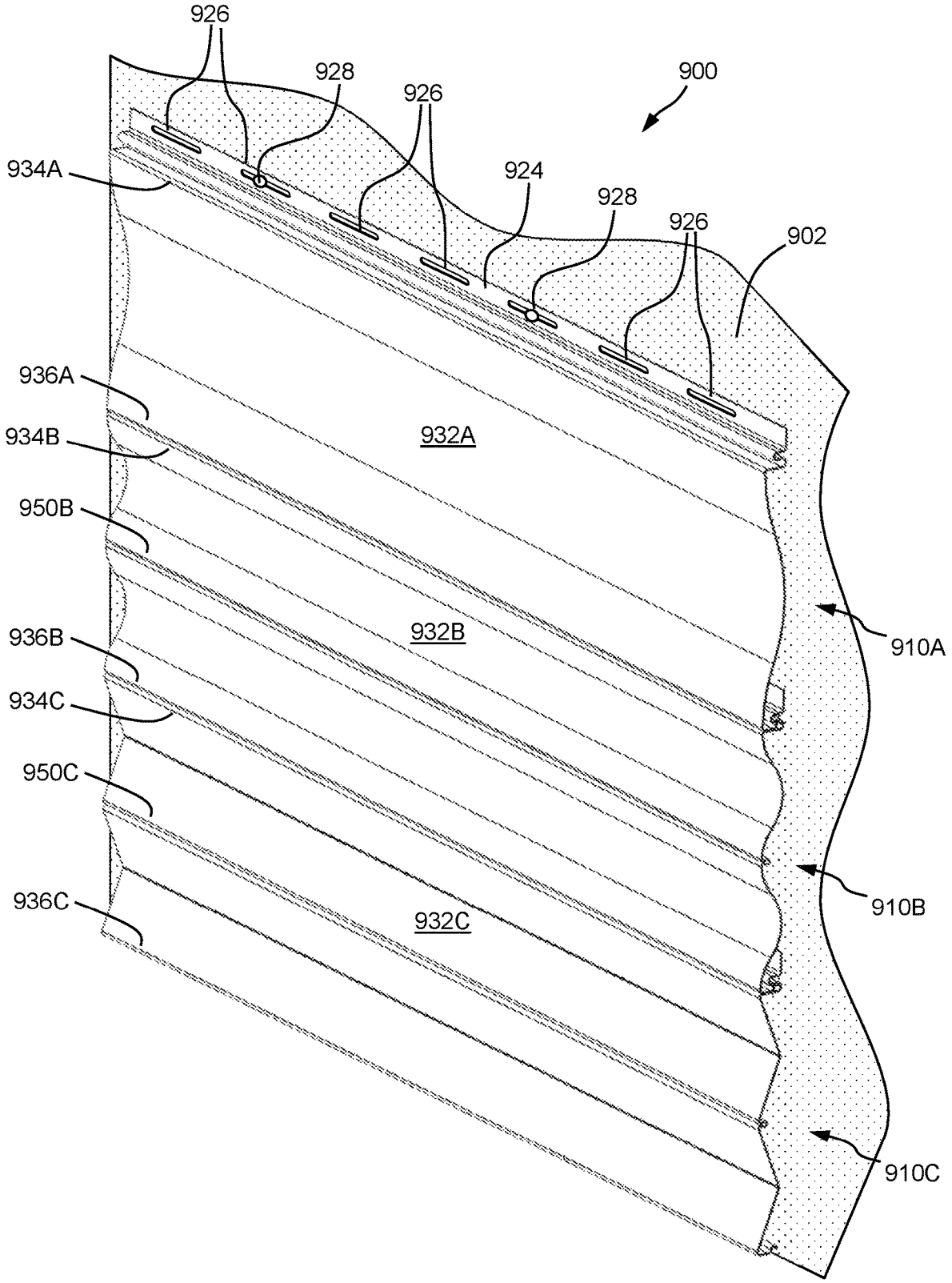
FIG. 9 is a schematic perspective view of a siding system according to an embodiment of the disclosure.

Such a building surface siding system is shown in FIG. 9. Siding system 900 includes a first siding panel 910A attached to a support structure 902 and a second siding panel 910B coupled to first siding panel 910A and attached to support structure 902. First siding panel 910A has a panel body with a first contoured profile 932A. In particular, the first contoured profile 932A of first siding panel 910A is in the form of a single rolling wave that extends from the upper edge 934A through a trough to the lower edge 936A. Siding system 900 also includes a second siding panel 910B that is also attached to support structure 902. Second siding panel 910B has a panel body with a second contoured profile 932B. The second contoured profile 932B is in the form of a double rolling wave with an upper wave that extends from the upper edge 934B through a trough to a peak 950B and a lower wave that extends from the peak 950B through a trough to the lower edge 936B. The first siding panel 910A is attached to the second panel 910B by connecting the lower lock 980A of first siding panel 910A with the upper lock 970B of second siding panel 910B.

In certain embodiments of the building surface siding system as otherwise described herein, the depth of the first siding panel is the same as the depth of the second siding panel. For example, the depth of first siding panel 910A of siding system 900 is the same as the depth of second siding panel 910B. As a result, the surfaces at the front of first siding panel 910A and second siding panel 910B project outward the same distance from support structure 902. In particular, upper edge 934A and lower edge 936A of contoured profile 932A of first siding panel 910A project outward from support structure 902 the same distance as upper edge 934B and lower edge 936B of contoured profile 932B of second siding panel 910B.

In certain embodiments of the building surface siding system as otherwise described herein, the lower edge of the panel body of the first siding panel abuts the upper edge of the panel body of the second siding panel. For example, lower edge 936A of first siding panel 910A abuts upper edge 934B of second siding panel 910B. Accordingly, because edges abut one another and the depth of first siding panel 910A and second siding panel 910B are the same, the surface flows evenly from first siding panel 910A to second siding panel 910B.

In certain embodiments of the building surface siding system as otherwise described herein, the system further includes a third siding panel according to the disclosure attached to the support structure and coupled to the second siding panel. For example, siding system 900 includes a third siding panel 910C that is also attached to support structure 902.

In certain embodiments of the building surface siding system as otherwise described herein, the third siding panel has a panel body with a third contoured profile that is different from the first siding profile and the second contoured profile. For example, third siding panel 910C of siding system 900 has a panel body with a third contoured profile 932C. The third contoured profile 932B is different from the first contoured profile 932A and the second contoured profile 932B. In particular, third contoured profile 932C is in the form of an angled pattern with an upper portion that extends from the upper edge 934C through a trough to a peak 950C and a lower portion that extends from the peak 950C through a trough to the lower edge 936C.

Figure 10:
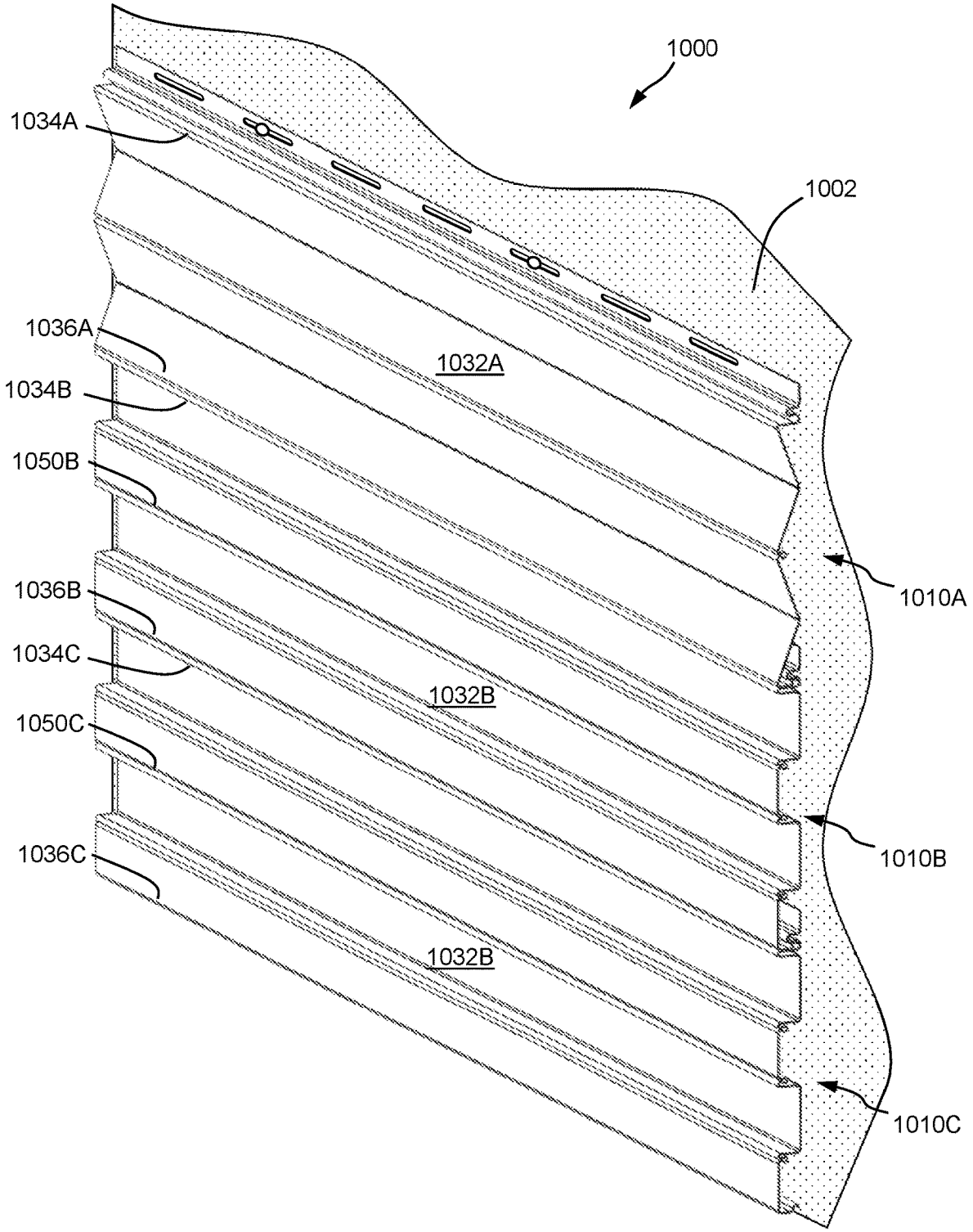
FIG. 10 is a schematic perspective view of a siding system according to another embodiment of the disclosure.
Figure 11:
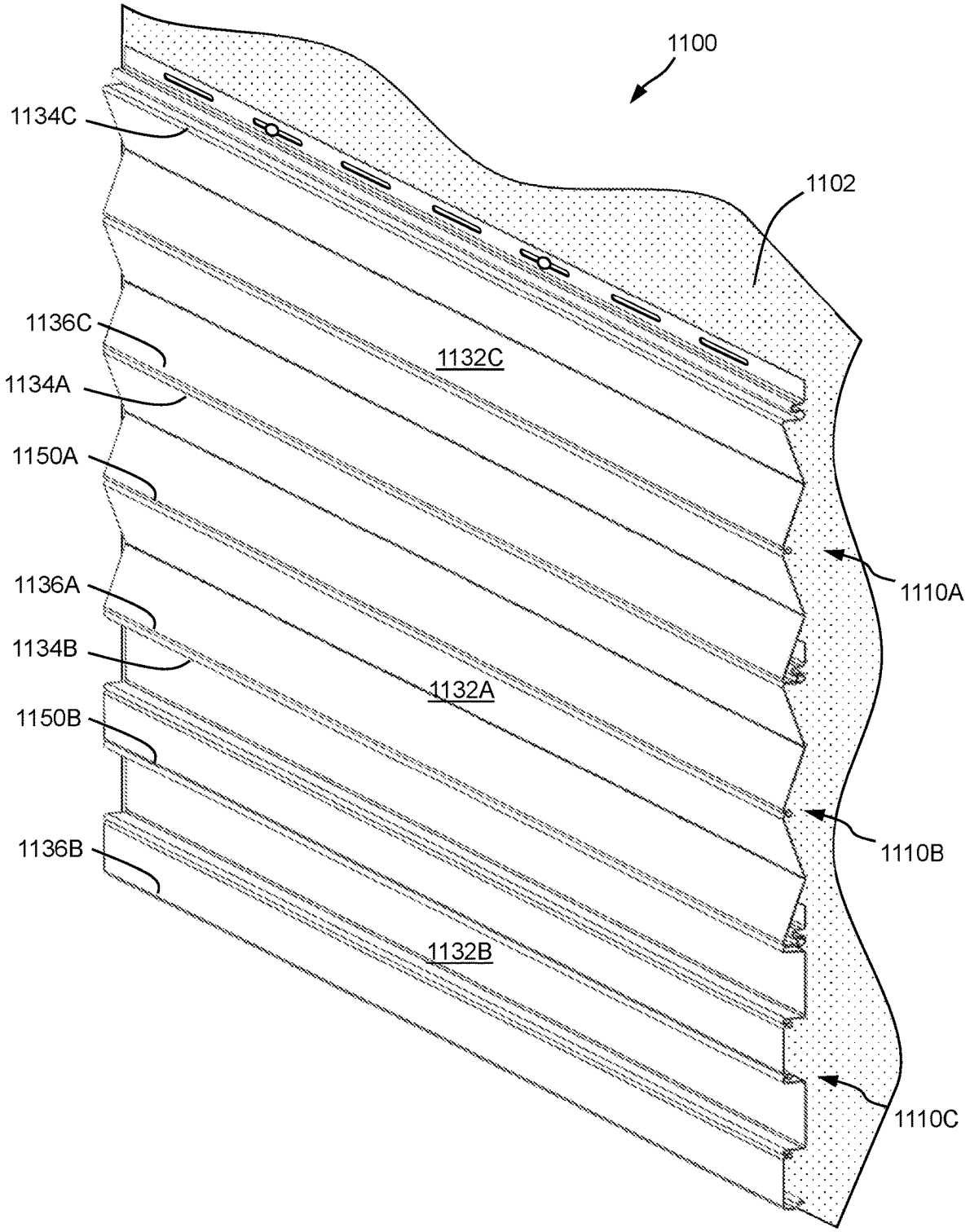
FIG. 11 is a schematic perspective view of a siding system according to yet another embodiment of the disclosure.
Figure 12:
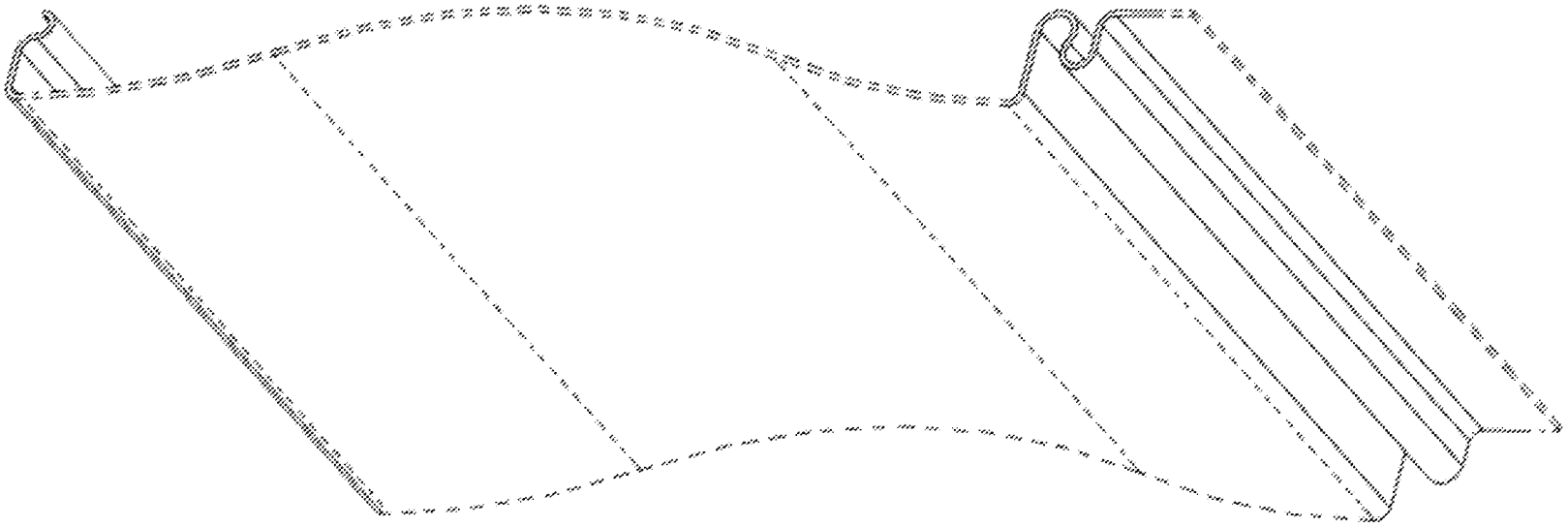
FIG. 12 is a perspective view illustrating the upper and lower locks of a siding panel.
Figure 13:
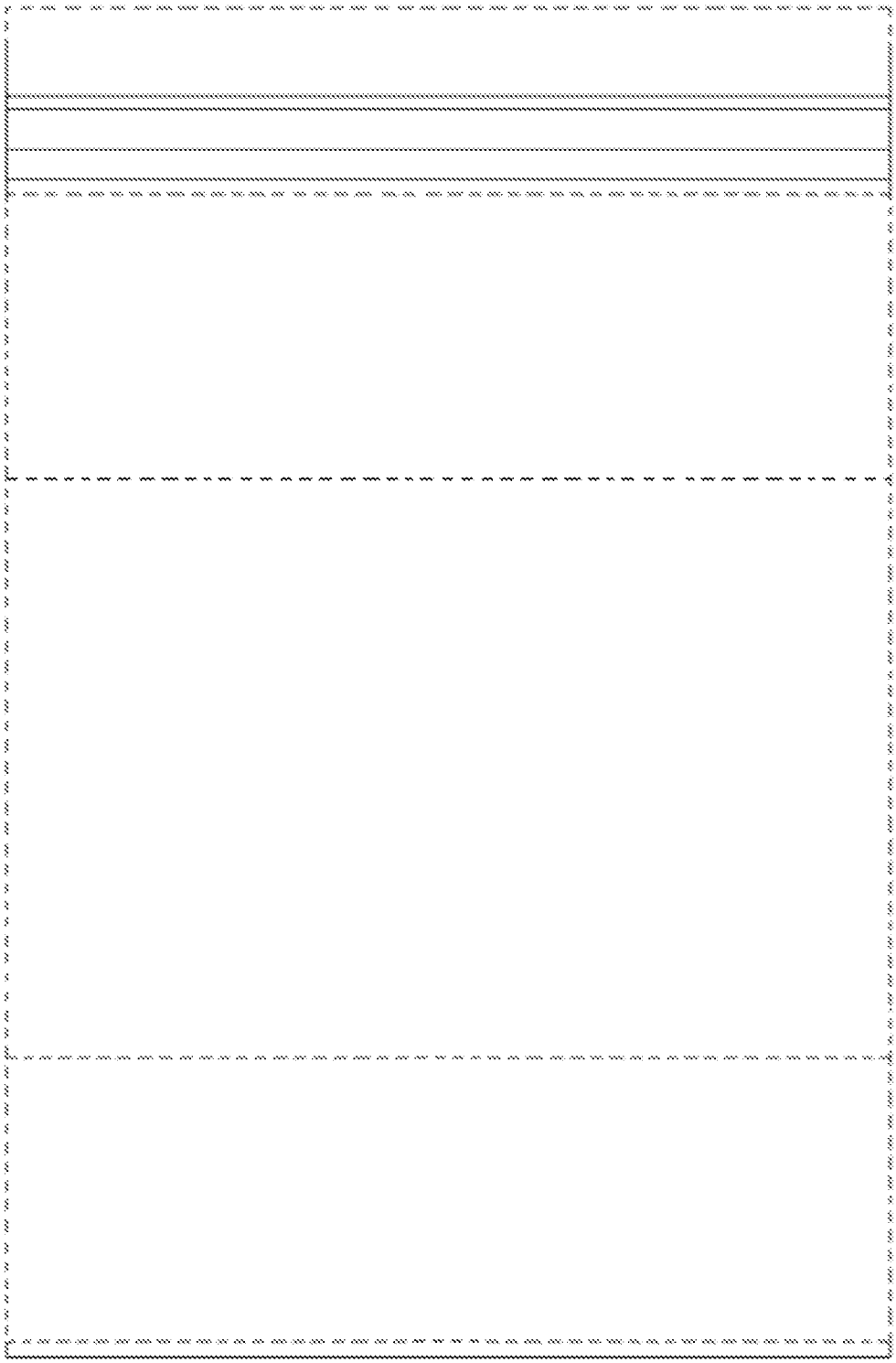
FIG. 13 is a front view of the siding panel of FIG. 12.
Figure 14:
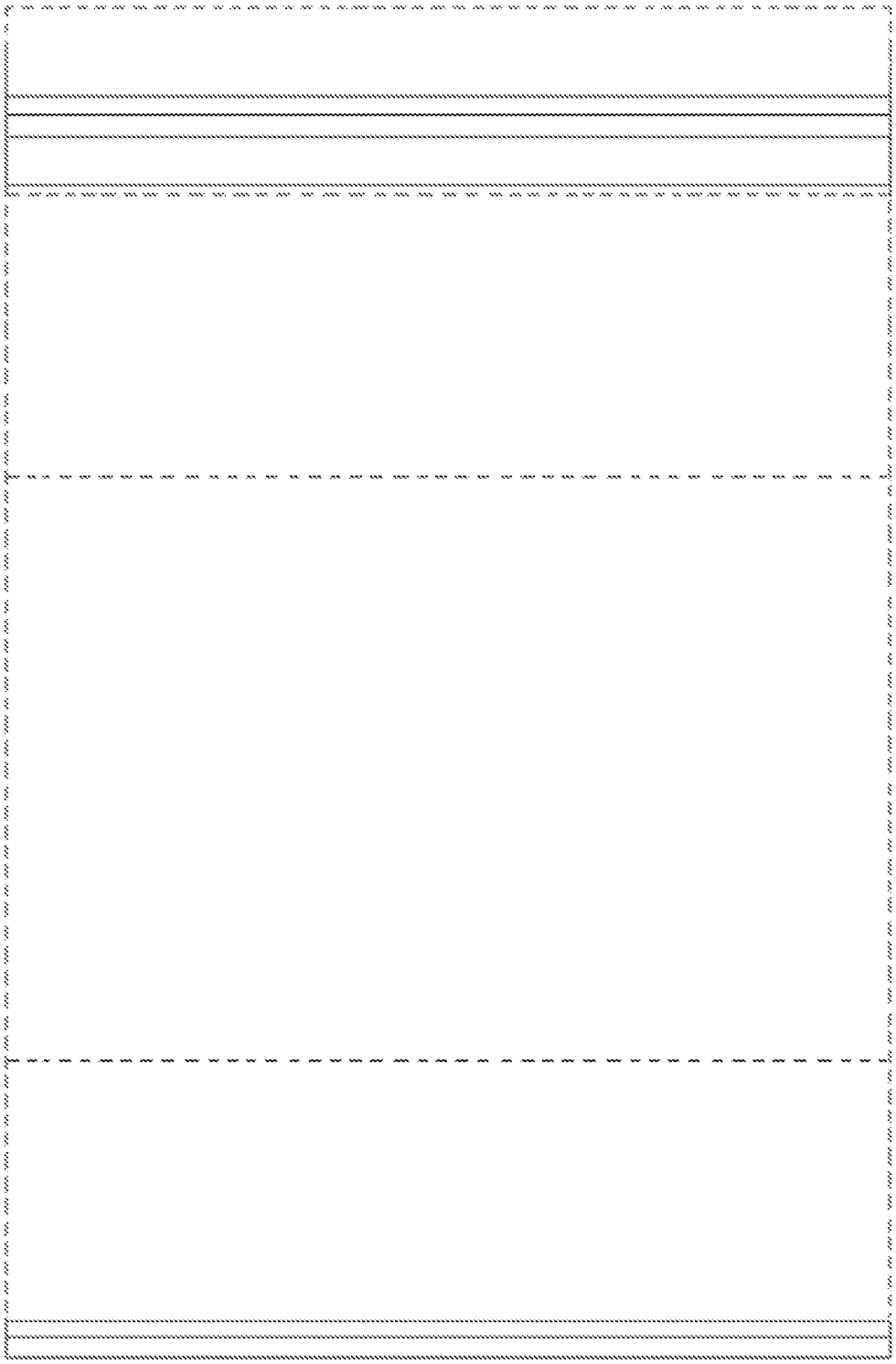
FIG. 14 is a rear view of the siding panel of FIG. 12.
Figure 15:
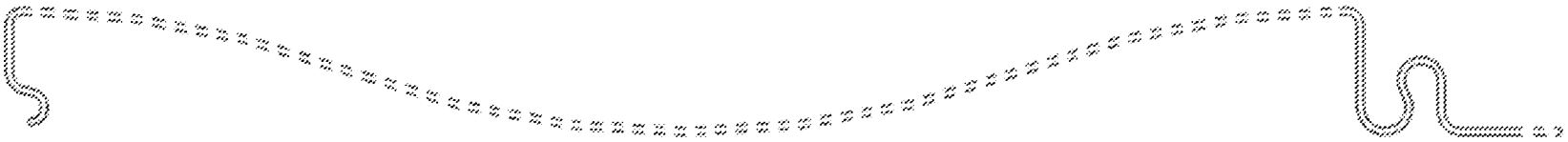
FIG. 15 is a right side view of the siding panel of FIG. 12.
Figure 16:
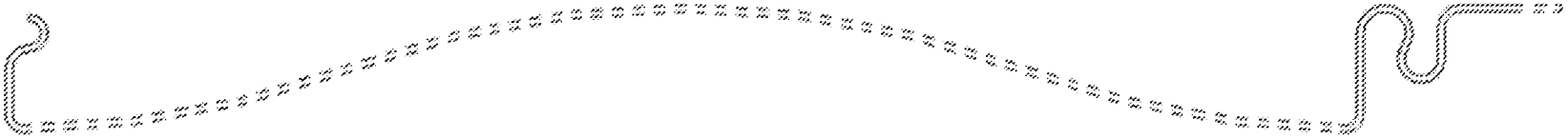
FIG. 16 is a left side view of the siding panel of FIG. 12.
Figure 17:
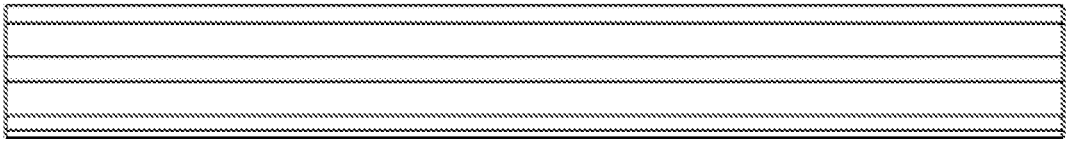
FIG. 17 is a top view of the siding panel of FIG. 12.
Figure 18:
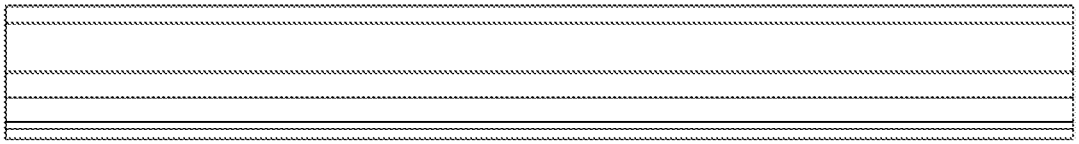
FIG. 18 is a bottom view of the siding panel of FIG. 12.

In certain embodiments of the building surface siding system as otherwise described herein, the third siding panel has a panel body with the second contoured profile. Such a siding system is shown in FIG. 10. Siding system 1000 includes a first siding panel 1010A attached to support structure 1002. First siding panel 110A has a panel body with a first contoured profile 1032A. In particular, the first contoured profile 1032A of first siding panel 1010A is in the form of an angled pattern that extends from an upper edge 1034A to a lower edge 1036A. Siding system 1000 also includes a second siding panel 1010B attached to support structure 1002 and coupled to first siding panel 1010A. Second siding panel 1010B has a panel body with a second contoured profile 1032B. The second contoured profile 1032B is in the form of a square pattern that extends from the upper edge 1034B to a lower edge 1036B. Siding system 1000 also includes a third siding panel 1010C attached to support structure 1002 and coupled to second siding panel 101B. Third siding panel 1010C has the same contoured profile as that of second siding panel 1010B. In other words, siding system 1000 includes two siding panels with the same contoured profile positioned below a siding panel with a different contoured profile, specifically second siding panel 1010B and third siding panel 1010C that have the same contoured profile and are positioned below first siding panel 1010A which has a different contoured profile.

In certain embodiments of the building surface siding system as otherwise described herein, the third siding panel has a panel body with the first contoured profile. In other words, in some embodiments, the first siding panel has one contoured profile while the siding panels above and below the first siding panel have a different contoured profile.

In certain embodiments of the building surface siding system as otherwise described herein, the siding system further includes a third siding panel according to the disclosure attached to the support structure and coupled to the first siding panel, where the third siding panel has a panel body with the first contoured profile. In other words, in some embodiments, two siding panels having the same contoured profile are positioned above a siding panel having a different contoured profile. For example, siding system 1100 includes a first siding panel 1110A attached to support structure 1102. First siding panel 110A has a panel body with a first contoured profile 1132A. In particular, the first contoured profile 1132A of first siding panel 1110A is in the form of an angled pattern that extends from an upper edge 1134A to a lower edge 1136A. Siding system 1100 also includes a second siding panel 1110B attached to support structure 1102 and coupled to first siding panel 1110A. Second siding panel 1110B has a panel body with a second contoured profile 1132B. The second contoured profile 1132B is in the form of a square pattern that extends from the upper edge 1134B to a lower edge 1136B. Siding system 1100 also includes a third siding panel 1110C attached to support structure 1102 and coupled to first siding panel 111A. Third siding panel 1110C has the same contoured profile as that of second siding panel 1110A. In other words, siding system 1100 includes two siding panels with the same contoured profile positioned above a siding panel with a different contoured profile, specifically third siding panel 1110C and first siding panel 1110A that have the same contoured profile and are positioned above second siding panel 1110B which has a different contoured profile.

In certain embodiments of the building surface siding system as otherwise described herein, the support structure is an exterior sheathing. For example, support structure 902 of building surface siding system 900 is configured as an exterior sheathing, for example of a house.

In certain embodiments of the building surface siding system as otherwise described herein, each of the siding panels is attached to the support structure using mechanical fasteners. For example, in some embodiments, the siding panels are attached to the support structure using nails or screws. Further, in some embodiments, the fastening strip includes apertures for receiving mechanical fasteners, and the mechanical fasteners extend through the apertures to secure the siding panels to the support structure. For example, first siding panel 910A of building surface siding system 900 is attached to support structure 902 by mechanical fasteners 928 that pass through apertures 926A in fastening strip 924A. The other siding panels 910B and 910C of siding system 900 are also attached to support structure 902 using mechanical fasteners which are obscured from view by the panel body of a neighboring siding panel.

In other embodiments the fastening strips are free of apertures. For example, in some embodiments, the fastening strips are configured to have mechanical fasteners penetrate through the fastening strip. Still, in other embodiments the fastening strip includes an adhesive for securing the fastening strip to a surface of an underlying support structure. In some embodiments, the fastening strip may include indicia that identifies length along the building surface panel.

Various embodiments of the disclosure are described by the following enumerated embodiments, which may be combined in any number and in any combination not logically or technically inconsistent.

Embodiment 1. A siding panel having a length extending from a first end to a second end, a width extending from an upper side to a lower side, and a depth extending from a rear elevation to a front elevation, the siding panel comprising:

- a fastening strip at the upper side;
- an upper lock adjacent to the fastening strip;
- a lower lock at the lower side; and
- a panel body extending from the upper lock to the lower lock, the panel body having a contoured profile including:
  - an upper edge that is disposed at the front elevation and abuts the upper lock,
  - a lower edge that is disposed at the front elevation and abuts the lower lock, and
  - a first section disposed between the upper edge and the lower edge that projects toward the rear elevation of the siding panel to a first trough.

Embodiment 2. The siding panel according to embodiment 1, wherein the first section has a curved slope.

Embodiment 3. The siding panel according to embodiment 1, wherein the first section has a flat angled slope.

Embodiment 4. The siding panel according to embodiment 1, wherein the first section projects substantially parallel to the depth direction of the siding panel.

Embodiment 5. The siding panel according to any of embodiments 1 to 4, wherein the first trough includes a planar rear section that is perpendicular to the depth direction.

Embodiment 6. The siding panel according to any of embodiments 1 to 5, wherein the contoured profile includes a second section that projects from the first trough to the lower edge.

Embodiment 7. The siding panel according to any of embodiments 1 to 5, wherein the contoured profile includes a second section that projects from the first trough to a peak disposed between the upper edge and the lower edge.

Embodiment 8. The siding panel according to embodiment 7, wherein the peak includes a planar front section that is perpendicular to the depth direction.

Embodiment 9. The siding panel according to embodiment 7 or embodiment 8, further comprising:

a third section that extends from the peak to a second trough; and a fourth section that extends from the second trough to the lower edge.

Embodiment 10. The siding panel according to any of embodiments 1 to 9, wherein the first trough is disposed at the rear elevation Embodiment 11. The siding panel according to any of embodiments 1 to 10, wherein the contoured profile includes a groove extending along the length of the siding panel.

Embodiment 12. The siding panel according to embodiment 11, wherein the groove is disposed at a peak in the contoured profile.

Embodiment 13. The siding panel according to any of embodiments 1 to 12, wherein the contoured profile includes a bead extending along the length of the siding panel.

Embodiment 14. The siding panel according to any of embodiments 1 to 13, wherein the upper lock includes a recess configured to receive an insert of the lower lock.

Embodiment 15. The siding panel according to embodiment 14, wherein the recess includes a constricted opening.

Embodiment 16. The siding panel according to embodiment 14 or embodiment 15, wherein the insert is in the form of a hook.

Embodiment 17. The siding panel according to embodiment 14 or embodiment 15, wherein the insert is bulbous.

Embodiment 18. The siding panel according to any of embodiments 14 to 17, wherein the recess is disposed at the base of a cavity, and the insert is disposed at the end of a leg.

Embodiment 19. The siding panel according to any of embodiments 1 to 18, wherein a cross section of the contoured profile is substantially uniform along the length of the siding panel.

Embodiment 20. The siding panel according to any of embodiments 1 to 19, wherein the depth of the siding panel is at least 2 inches, e.g., at least 2.5 inches, e.g., at least 3 inches.

Embodiment 21. The siding panel according to any of embodiments 1 to 20, wherein the depth of the siding panel is no more than 8 inches, e.g., no more than 6 inches, e.g., no more than 4.5 inches.

Embodiment 22. The siding panel according to any of embodiments 1 to 21, wherein the length of the siding panel is at least 3 feet, e.g., at least 6 feet, e.g., at least 8 feet.

Embodiment 23. The siding panel according to any of embodiments 1 to 22, wherein the length of the siding panel is no more than 30 feet, e.g., no more than 20 feet, e.g., no more than 15 feet.

Embodiment 24. The siding panel according to any of embodiments 1 to 23, wherein the width of the panel body is at least 4 inches, e.g., at least 6 inches, e.g., at least 8 inches.

Embodiment 25. The siding panel according to any of embodiments 1 to 24, wherein the width of the panel body is no more than 24 inches, e.g., no more than 18 inches, e.g., no more than 14 inches.

Embodiment 26. The siding panel according to any of embodiments 1 to 25, wherein the panel body has a material thickness in a range from 0.03 inches to 0.20 inches.

Embodiment 27. The siding panel according to any of embodiments 1 to 26, wherein the panel body is formed of one or more of polypropylene, polyethylene, polyvinyl chloride (PVC), acrylonitrile styrene acrylate (ASA), acrylonitrile ethylene styrene (AES), polyurethane, or acrylonitrile butadiene styrene (ABS).

Embodiment 28. The siding panel according to any of embodiments 1 to 27, wherein the fastening strip includes apertures configured to receive mechanical fasteners.

Embodiment 29. A siding kit for covering a building surface, the siding kit comprising:

a first siding panel according to any of embodiments 1 to 28, the first siding panel having a panel body with a first contoured profile; and a second siding panel according to any of embodiments 1 to 28 configured to attach to the first siding panel, the second siding panel having a panel body with a second contoured profile that is different from the first contoured profile.

Embodiment 30. The siding kit according to embodiment 29, wherein the depth of the first siding panel is the same as the depth of the second siding panel.

Embodiment 31. The siding kit according to embodiment 29 or embodiment 30, further comprising a third siding panel according to any of embodiments 1 to 28.

Embodiment 32. The siding kit according to embodiment 31, wherein the third siding panel has a panel body with a third contoured profile that is different from the first siding profile and the second contoured profile.

Embodiment 33. The siding kit according to embodiment 31, wherein the third siding panel has a panel body with the second contoured profile.

Embodiment 34. A building surface siding system comprising:

a support structure;

a first siding panel according to any of embodiments 1 to 28 attached to the support structure, the first siding panel having a panel body with a first contoured profile; and a second siding panel according to any of embodiments 1 to 28 attached to the support structure and coupled to the first siding panel, the second siding panel having a panel body with a second contoured profile that is different from the first contoured profile.

Embodiment 35. The building surface siding system according to embodiment 34, wherein the depth of the first siding panel is the same as the depth of the second siding panel.

Embodiment 36. The building surface siding system according to embodiment 34 or embodiment 35, wherein the lower edge of the panel body of the first siding panel abuts the upper edge of the panel body of the second siding panel.

Embodiment 37. The building surface siding system according to any of embodiments 34 to 36, further comprising a third siding panel according to any of embodiments 1 to 28 attached to the support structure and coupled to the second siding panel.

Embodiment 38. The building surface siding system according to embodiment 37, wherein the third siding panel has a panel body with a third contoured profile that is different from the first siding profile and the second contoured profile.

Embodiment 39. The building surface siding system according to embodiment 37, wherein the third siding panel has a panel body with the second contoured profile.

Embodiment 40. The building surface siding system according to embodiment 37, wherein the third siding panel has a panel body with the first contoured profile.

Embodiment 41. The building surface siding system according to any of embodiments 34 to 36, further comprising a third siding panel according to any of embodiments 1 to 28 attached to the support structure and coupled to the first siding panel.

Embodiment 42. The building surface siding system according to embodiment 41, wherein the third siding panel has a panel body with the first contoured profile.

Embodiment 43. The building surface siding system according to any of embodiments 34 to 42, wherein the support structure is an exterior sheathing.

Embodiment 44. The building surface siding system according to any of embodiments 34 to 43, wherein each of the siding panels is attached to the support structure using mechanical fasteners.

Embodiment 45. The building surface siding system according to embodiment 44, wherein the mechanical fasteners extend through apertures in the fastening strips.

It will be apparent to those skilled in the art that various modifications and variations can be made to the processes and devices described here without departing from the scope of the disclosure. Thus, it is intended that the present disclosure cover such modifications and variations of this invention provided they come within the scope of the appended claims and their equivalents.

What is claimed is:

1. A siding panel having a length extending from a first end to a second end, a width extending from an upper side to a lower side, and a depth extending from a rear elevation to a front elevation, the siding panel comprising:

a fastening strip at the upper side;

an upper lock adjacent to the fastening strip;

a lower lock at the lower side; and a panel body extending from the upper lock to the lower lock, the panel body having a contoured profile including:

an upper edge that is disposed at the front elevation and abuts the upper lock, a lower edge that is disposed at the front elevation and abuts the lower lock, a first trough extending along the length of the siding panel, the first trough comprising a rear section set rearward from the front elevation, a first section extending along the length of the siding panel, the first section being disposed between the upper edge of the panel body and the lower edge of the panel body, the first section having a front edge disposed at the front elevation and a rear edge at an upper edge of the first trough, the first section projecting toward the rear elevation of the siding panel, a second section extending along the length of the siding panel, the second section being disposed between the upper edge of the panel body and the lower edge of the panel body, the second section having a front edge disposed at the front elevation and a rear edge at a lower edge of the first trough, the second section projecting toward the rear elevation of the siding panel, a front section extending along the length of the siding panel, the front section having an upper edge at the front edge of the second section and a lower edge, the front section being disposed at the front elevation, and one or more of a first groove extending along the length of the siding panel at the upper edge of the front section, the first groove projecting toward the rear elevation, and a second groove extending along the length of the siding panel at the lower edge of the front section, the second groove projecting toward the rear elevation.

2. The siding panel according to claim 1, wherein the first section projects substantially parallel to the depth direction of the siding panel and the second section projects substantially parallel to the depth direction of the siding panel.

3. The siding panel according to claim 1, wherein the rear section of the first trough is a planar rear section that is perpendicular to the depth direction.

4. The siding panel according to claim 1, wherein the front section is a planar front section that is perpendicular to the depth direction.

5. The siding panel according to claim 1, wherein the first trough is disposed at the rear elevation.

6. The siding panel according to claim 1, wherein the upper lock includes a recess configured to receive an insert of the lower lock.

7. The siding panel according to claim 6, wherein the recess includes a constricted opening and is disposed at the base of a cavity, and the insert is disposed at the end of a leg.

8. The siding panel according to claim 1, wherein a cross section of the contoured profile is substantially uniform along the length of the siding panel.

9. A building surface siding system comprising:

a support structure;

a first siding panel and a second siding panel, each according to claim 1, wherein the first siding panel is attached to the support structure and has a panel body with a first contoured profile; and the second siding panel is attached to the support structure and coupled to the first siding panel.

10. The siding panel according to claim 1, wherein the upper lock includes a cavity that extends along the upper edge of the panel body and is configured to receive an insert of a lower lock of an adjacent siding panel such that the upper edge of the panel body of the siding panel abuts a lower edge of the panel body of the adjacent siding panel.

11. The siding panel according to claim 10, wherein the cavity of the upper lock is configured to receive the insert of the lower lock of the adjacent siding panel such that the upper edge of the panel body of the siding panel abuts a lower edge of the panel body of the adjacent siding panel to provide a substantially continuous appearance between the siding panel and the adjacent siding panel.

12. The siding panel according to claim 1, wherein the upper edge of the first section is disposed at the upper edge of the panel body.

13. A siding panel having a length extending from a first end to a second end, a width extending from an upper side to a lower side, and a depth extending from a rear elevation to a front elevation, the siding panel comprising:

a fastening strip at the upper side;

an upper lock adjacent to the fastening strip;

a lower lock at the lower side; and a panel body extending from the upper lock to the lower lock, the panel body having a contoured profile including:

an upper edge that is disposed at the front elevation and abuts the upper lock, a lower edge that is disposed at the front elevation and abuts the lower lock, a front section extending along the length of the siding panel, the front section having an upper edge and a lower edge, the front section being disposed at the front elevation, a first trough extending along the length of the siding panel, the first trough comprising a rear section set rearward from the front elevation, a first section extending along the length of the siding panel, the first section being disposed between the upper edge of the panel body and the lower edge of the panel body, the first section having a front edge disposed at the lower edge of the front section and a rear edge at an upper edge of the first trough, the first section projecting toward the rear elevation of the siding panel, a second section extending along the length of the siding panel, the second section being disposed between the upper edge of the panel body and the lower edge of the panel body, the second section having a front edge disposed at the front elevation and a rear edge at a lower edge of the first trough, the second section projecting toward the rear elevation of the siding panel, and one or more of a first groove extending along the length of the siding panel at the upper edge of the front section, the first groove projecting toward the rear elevation, and a second groove extending along the length of the siding panel at the lower edge of the front section, the second groove projecting toward the rear elevation.

14. The siding panel according to claim 13, wherein the first section projects substantially parallel to the depth direction of the siding panel and the second section projects substantially parallel to the depth direction of the siding panel.

15. The siding panel according to claim 13, wherein the rear section of the first trough is a planar rear section that is perpendicular to the depth direction, and the front section is a planar front section that is perpendicular to the depth direction.

16. The siding panel according to claim 13, wherein the first trough is disposed at the rear elevation.

17. The siding panel according to claim 13, wherein the upper edge of the front section is disposed at the upper edge of the panel body.

18. The siding panel according to claim 13, wherein the upper lock includes a cavity that extends along the upper edge of the panel body and is configured to receive an insert of a lower lock of an adjacent siding panel such that the upper edge of the panel body of the siding panel abuts a lower edge of the panel body of the adjacent siding panel.

19. The siding panel according to claim 18, wherein the cavity of the upper lock is configured to receive the insert of the lower lock of the adjacent siding panel such that the upper edge of the panel body of the siding panel abuts a lower edge of the panel body of the adjacent siding panel to provide a substantially continuous appearance between the siding panel and the adjacent siding panel.

* * * * *